US009720355B2

(12) United States Patent
Ohsugi et al.

(10) Patent No.: US 9,720,355 B2
(45) Date of Patent: Aug. 1, 2017

(54) IMAGE FORMING APPARATUS

(71) Applicants: Tatsuya Ohsugi, Kanagawa (JP); Kenji Sugiura, Kanagawa (JP); Jyunya Sakuraba, Kanagawa (JP); Hirokazu Ishii, Tokyo (JP); Toshitaka Yamaguchi, Kanagawa (JP); Hiroyoshi Haga, Kanagawa (JP); Naohiro Kumagai, Kanagawa (JP); Seiichi Kogure, Kanagawa (JP); Junpei Fujita, Kanagawa (JP); Yuuji Wada, Kanagawa (JP); Kazuki Yogosawa, Tokyo (JP); Shinya Tanaka, Kanagawa (JP); Masayoshi Nakayama, Kanagawa (JP)

(72) Inventors: Tatsuya Ohsugi, Kanagawa (JP); Kenji Sugiura, Kanagawa (JP); Jyunya Sakuraba, Kanagawa (JP); Hirokazu Ishii, Tokyo (JP); Toshitaka Yamaguchi, Kanagawa (JP); Hiroyoshi Haga, Kanagawa (JP); Naohiro Kumagai, Kanagawa (JP); Seiichi Kogure, Kanagawa (JP); Junpei Fujita, Kanagawa (JP); Yuuji Wada, Kanagawa (JP); Kazuki Yogosawa, Tokyo (JP); Shinya Tanaka, Kanagawa (JP); Masayoshi Nakayama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/265,562

(22) Filed: Sep. 14, 2016

(65) Prior Publication Data

US 2017/0003630 A1 Jan. 5, 2017

Related U.S. Application Data

(63) Continuation of application No. 14/881,611, filed on Oct. 13, 2015, now Pat. No. 9,459,564.

(30) Foreign Application Priority Data

Oct. 15, 2014 (JP) ..... 2014-211167

(51) Int. Cl.
*G03G 15/20* (2006.01)
*G03G 15/16* (2006.01)

(52) U.S. Cl.
CPC ..... *G03G 15/1675* (2013.01); *G03G 15/162* (2013.01); *G03G 15/1605* (2013.01); *G03G 15/1665* (2013.01); *G03G 15/1685* (2013.01)

(58) Field of Classification Search
CPC ..... G03G 15/162; G03G 15/1665; G03G 15/1675; G03G 15/1685
(Continued)

(56) References Cited

U.S. PATENT DOCUMENTS 5,515,146 A 5/1996 Harasawa et al.
5,631,725 A 5/1997 Harasawa et al.
(Continued)

FOREIGN PATENT DOCUMENTS

JP 2011-013241 1/2011
JP 2014-010383 1/2014

OTHER PUBLICATIONS

U.S. Appl. No. 14/712,204, filed May 14, 2015.
U.S. Appl. No. 14/742,730, filed Jun. 18, 2015.
U.S. Appl. No. 14/800,083, filed Jul. 15, 2015.

*Primary Examiner* — Benjamin Schmitt
(74) *Attorney, Agent, or Firm* — Oblon, McClelland, Maier & Neustadt, L.L.P.

(57) ABSTRACT

An image forming apparatus includes an image bearer, a transfer member, and a power source. The image bearer includes a plurality of layers. The transfer member forms a transfer nip between the image bearer and the transfer member. The power source outputs a transfer bias to transfer
(Continued)

a toner image from the image bearer onto a recording sheet in the transfer nip. The transfer bias alternates between a transfer-side bias that causes the toner image to move from the image bearer to the recording sheet, and an opposite-side bias different from the transfer-side bias. A duty ratio of a time period, during which the opposite-side bias is output, relative to one cycle of a waveform, is greater than 50%.

20 Claims, 10 Drawing Sheets

(58) Field of Classification Search
USPC ..... 399/66, 78, 314
See application file for complete search history.

(56) References Cited

U.S. PATENT DOCUMENTS 5,812,919 A 9/1998 Takano et al.
5,822,667 A 10/1998 Hayama et al.
5,930,573 A 7/1999 Miyamoto et al.
6,188,862 B1 2/2001 Ishii
6,282,386 B1 8/2001 Ishii
7,295,796 B1 11/2007 Murakami et al.
2003/0035658 A1 2/2003 Ishii
2003/0219296 A1 11/2003 Kabata et al.
2005/0180767 A1 8/2005 Ishii et al.
2007/0003333 A1 1/2007 Ishii
2008/0112734 A1 5/2008 Furuya et al.
2008/0118281 A1 5/2008 Saeki et al.
2008/0152399 A1* 6/2008 Umeda ..... G03G 15/0131 399/307
2010/0215389 A1 8/2010 Imahori et al.
2010/0221029 A1 9/2010 Minbu et al.
2010/0303518 A1* 12/2010 Aimoto ..... G03G 15/1675 399/314
2010/0329707 A1* 12/2010 Yamada ..... G03G 15/161 399/44
2011/0103822 A1 5/2011 Sugiura et al.
2012/0224870 A1 9/2012 Kikuchi et al.
2012/0224879 A1* 9/2012 Fujita ..... G03G 15/0189 399/94
2012/0230715 A1 9/2012 Ogino et al.
2012/0237234 A1 9/2012 Sugimoto et al.
2012/0237260 A1 9/2012 Sengoku et al.
2012/0237271 A1 9/2012 Sengoku et al.
2012/0308250 A1 12/2012 Shimizu et al.
2012/0315058 A1 12/2012 Shimizu et al.
2012/0328314 A1 12/2012 Sugimoto et al.
2013/0004190 A1 1/2013 Sengoku et al.
2013/0011155 A1 1/2013 Ogiyama et al.
2013/0064559 A1 3/2013 Nakamura et al.
2013/0089363 A1 4/2013 Mimbu et al.
2013/0094870 A1 4/2013 Shimizu et al.
2013/0114982 A1 5/2013 Ichihashi et al.
2013/0121714 A1 5/2013 Tanaka et al.
2013/0136468 A1 5/2013 Shimizu et al.
2013/0136477 A1 5/2013 Ogiyama et al.
2013/0142531 A1 6/2013 Sugimoto et al.
2013/0148993 A1 6/2013 Aoki et al.
2013/0164011 A1 6/2013 Nakamura et al.
2013/0177329 A1 7/2013 Tanaka et al.
2013/0195483 A1 8/2013 Shimizu et al.
2013/0236201 A1 9/2013 Mizutani et al.
2013/0308968 A1 11/2013 Shinya et al.
2013/0315617 A1 11/2013 Sugiura et al.
2014/0010562 A1 1/2014 Tanaka et al.
2014/0029988 A1 1/2014 Shimizu et al.
2014/0079418 A1 3/2014 Tanaka et al.
2014/0241744 A1 8/2014 Ichikawa et al.
2014/0248064 A1 9/2014 Tanaka et al.
2014/0314435 A1 10/2014 Kato et al.
2014/0328603 A1 11/2014 Mizutani et al.
2014/0328604 A1 11/2014 Tanaka et al.
2015/0037054 A1 2/2015 Nagata et al.
2015/0212453 A1 7/2015 Tanaka

* cited by examiner

IMAGE FORMING APPARATUS

CROSS-REFERENCE TO RELATED APPLICATIONS

This application is a continuation of and claims the benefit of priority from U.S. Ser. No. 14/881,611, filed Oct. 13, 2015, which claims the benefit of priority from Japanese Patent Application No. 2014-211167, filed on Oct. 15, 2014, the entire contents of each of which are incorporated herein by reference.

BACKGROUND

Technical Field

Exemplary aspects of the present disclosure generally relate to an image forming apparatus, such as a copier, a facsimile machine, a printer, or a multi-functional system including a combination thereof, and more particularly to, an image forming apparatus including a power source that outputs a superimposed bias in which a direct current (DC) voltage is superimposed on an alternating current (AC) voltage.

Description of the Related Art

Image forming apparatuses equipped with a transfer bias output device that outputs a superimposed bias as a transfer bias in which an alternating current bias and a direct current bias are superimposed are known. In the image forming apparatuses of this kind, toner images formed on photoconductors through known electrophotographic process are primarily transferred onto a belt-type intermediate transfer member (hereinafter, intermediate transfer belt) and then secondarily onto a recording medium in a secondary transfer nip at which a contact roller contacts a front surface of the intermediate transfer belt. A back surface roller contacts a back surface of the intermediate transfer belt so as to interpose the intermediate transfer belt between the contact roller and the back surface roller.

In order to secondarily transfer the toner image through known electrostatic transfer process, a secondary transfer bias is applied to the back surface roller while the back surface roller contacts the back surface of the intermediate transfer belt. In order to enhance secondary transfer ability, a superimposed bias, in which an AC voltage and a DC voltage are superimposed, is output as the secondary transfer bias. In other words, the secondary transfer bias is a superimposed bias. The intermediate transfer belt is formed of multiple layers including a base formed into an endless loop on which a top layer having greater elasticity than the base is laminated.

In this configuration, while the durability of the intermediate transfer belt is maintained depending on the durability of the base, the elastic top layer of the intermediate transfer belt can tightly contact recessed portions of an uneven surface of paper such as Japanese paper called "Washi". Accordingly, the toner is transferred reliably to the recessed portions of the surface of the paper.

However, it has been recognized that when using regular paper or a coated sheet having a relatively smooth surface as a recording sheet in the image forming apparatus of this kind, improper secondary transfer occurs, which causes easily inadequate image density.

With respect to such a transfer failure, the present inventors have recognized the following. The intermediate transfer belt is interposed between the contact roller and the back surface roller at the secondary transfer nip, and a secondary transfer current flows between the contact roller and the back surface roller. When using a multilayer intermediate transfer belt, the secondary transfer current flows at the boundary between the layers in a thickness direction of the intermediate transfer belt along the circumferential direction of the intermediate transfer belt. As a result, at the secondary transfer nip the secondary transfer current flows not only in the center of the secondary transfer nip at which the nip pressure is the highest, but also at the nip start portion and at the nip end portion. This means that the secondary transfer current flows in the toner image on the intermediate transfer belt in the secondary transfer nip for an extended period of time.

Consequently, a significant amount of charges having a polarity opposite to the charge polarity of toner are injected to the toner, resulting in a decrease in a charge amount of toner Q/M when the toner has a normal polarity. In other words, the secondary transfer ability is degraded, causing inadequate image density.

SUMMARY

In view of the foregoing, in an aspect of this disclosure, there is provided an improved image forming apparatus including an image bearer, a transfer member, and a power source. The image bearer includes a plurality of layers. The transfer member forms a transfer nip between the image bearer and the transfer member. The power source outputs a transfer bias to transfer a toner image from the image bearer onto a recording sheet in the transfer nip. The transfer bias alternates between a transfer-side bias that causes the toner image to move from the image bearer to the recording sheet, and an opposite-side bias different from the transfer-side bias. A duty ratio of a time period, during which the opposite-side bias is output, relative to one cycle of a waveform, is greater than 50%.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
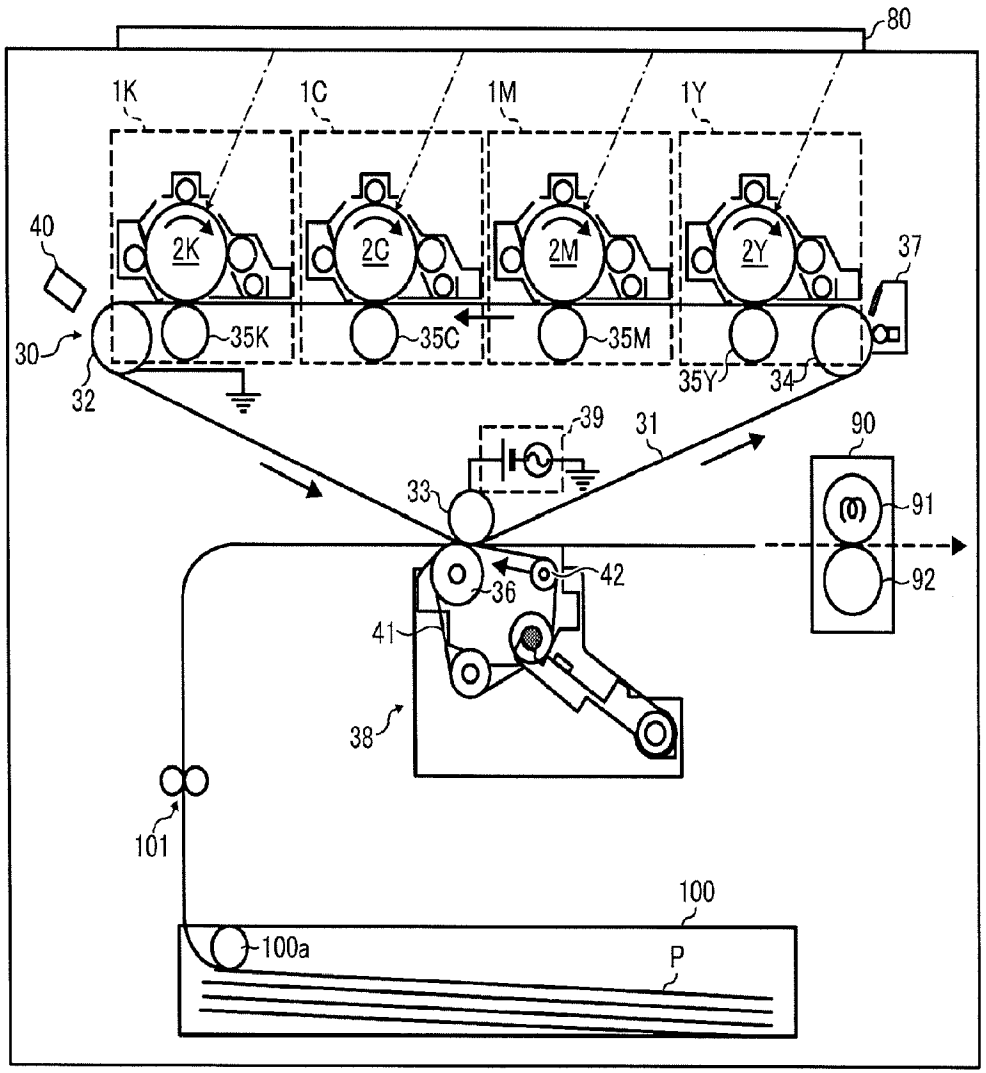
FIG. 1 is a schematic diagram illustrating a printer as an example of an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

With reference to FIG. 1, a description is provided of an electrophotographic color printer as an example of an image forming apparatus according to an illustrative embodiment of the present disclosure.

A basic configuration of the image forming apparatus is described below. FIG. 1 is a schematic diagram illustrating a printer as an example of the image forming apparatus. As illustrated in FIG. 1, the image forming apparatus includes four toner image forming units 1Y, 1M, 1C, and 1K for forming toner images, one for each of the colors yellow, magenta, cyan, and black, respectively. It is to be noted that the suffixes Y, M, C, and K denote colors yellow, magenta, cyan, and black, respectively. To simplify the description, the suffixes Y, M, C, and K indicating colors may be omitted herein, unless differentiation of colors is necessary. The image forming apparatus also includes a transfer unit 30 serving as a transfer device, an optical writing unit 80, a fixing device 90, a sheet cassette 100, and a pair of registration rollers 101.

Figure 2:
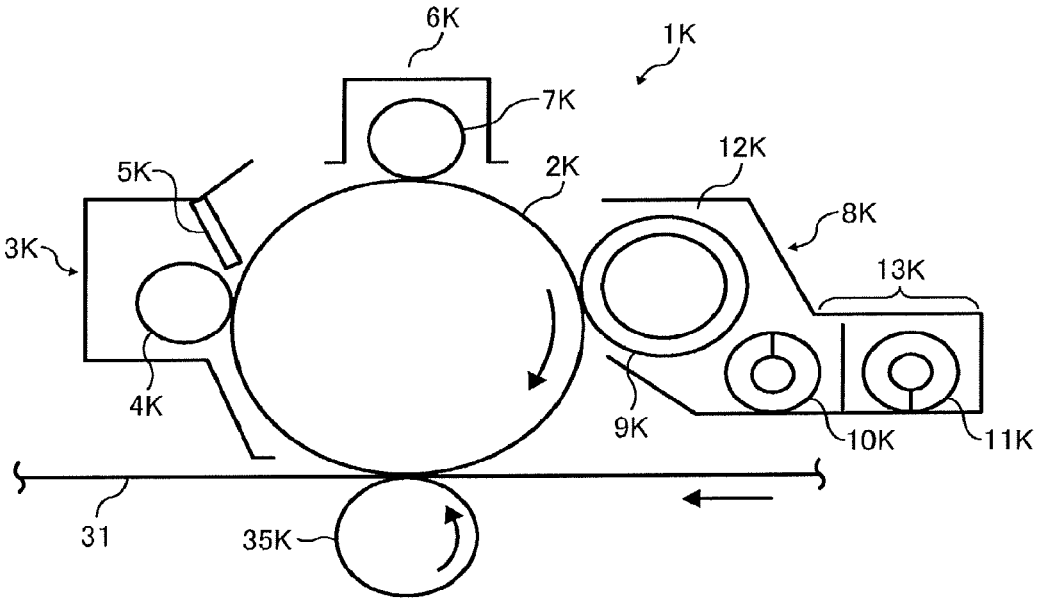
FIG. 2 is a schematic diagram illustrating a toner image forming unit for black color as a representative example of toner image forming units employed in the image forming apparatus of FIG. 1.

The toner image forming units 1Y, 1M, 1C, and 1K all have the same configuration as all the others, differing only in the color of toner employed. Thus, a description is provided of the toner image forming unit 1K for forming a toner image of black as a representative example of the toner image forming units 1Y, 1M, 1C, and 1K. The toner image forming units 1Y, 1M, 1C, and 1K are replaced upon reaching their product life cycles. With reference to FIG. 2, a description is provided of the toner image forming unit 1K as an example of the toner image forming units. FIG. 2 is a schematic diagram illustrating the toner image forming unit 1K. The toner image forming unit 1K includes a photoconductor 2K serving as an image bearer that bears a latent image. The photoconductor 2K is surrounded by various pieces of imaging equipment, such as a charging device 6K, a developing device 8K, a photoconductor cleaner 3K, and a charge remover. These devices are held by a common holder so that they are detachably attachable and replaced at the same time.

The photoconductor 2K includes a drum-shaped base on which an organic photosensitive layer is disposed. The photoconductor 2K is rotated in a clockwise direction by a driving device. The charging device 6K includes a charging roller 7K to which a charging bias is applied. The charging roller 7K contacts or is disposed in proximity to the photoconductor 2K to generate electrical discharge between the charging roller 7K and the photoconductor 2K, thereby charging uniformly the surface of the photoconductor 2K. According to the present illustrative embodiment, the photoconductor 2K is uniformly charged negatively, which is the same polarity as that of normally-charged toner. As a charging bias, an alternating current (AC) voltage superimposed on a direct current (DC) voltage is employed. The charging roller 7K includes a metal cored bar coated with a conductive elastic layer made of a conductive elastic material.

According to the present embodiment, the photoconductor 2K is charged by the charging roller 7K contacting the photoconductor 2K or disposed near the photoconductor 2K. Alternatively, a corona charger may be employed.

The uniformly charged surface of the photoconductor 2K is scanned by laser light projected from the optical writing unit 80, thereby forming an electrostatic latent image for black on the surface of the photoconductor 2K. The electrostatic latent image for the color black on the photoconductor 2K is developed with black toner by the developing device 8K. Accordingly, a visible image, also known as a toner image of black, is formed. As will be described later in detail, the toner image is transferred primarily onto an intermediate transfer belt 31 in a process known as a primary transfer process.

The image-bearer cleaning device 3K removes residual toner remaining on the surface of the photoconductor 2K after the primary transfer process, that is, after the photoconductor 2K passes through a primary transfer nip. The image-bearer cleaning device 3K includes a brush roller 4K and a cleaning blade 5K. The cleaning blade 5K is cantilevered, that is, one end of the cleaning blade 5K is fixed to the housing of the photoconductor cleaner 3K, and its free end contacts the surface of the photoconductor 2K. The brush roller 4K rotates and brushes off the residual toner from the surface of the photoconductor 2K while the cleaning blade 5K removes the residual toner by scraping.

The charge remover removes residual charge remaining on the photoconductor 2K after the surface thereof is cleaned by the photoconductor cleaner 3K. The surface of the photoconductor 2K is initialized in preparation for the subsequent imaging cycle.

The developing device 8K serving as a developer bearer includes a developing portion 12K and a developer conveyor 13K. The developing portion 12K includes a developing roller 9K inside thereof. The developer conveyor 13K mixes a black developing agent and transports the black developing agent. The developer conveyor 13K includes a first chamber equipped with a first screw 10K and a second chamber equipped with a second screw 11K. The first screw 10K and the second screw 11K are each constituted of a rotatable shaft and helical fighting wrapped around the circumferential surface of the shaft. Each end of the shaft of the first screw 10 and the second screw 11K in the axial direction of the shaft is rotatably held by shaft bearings.

The first chamber with the first screw 10K and the second chamber with the second screw 11K are separated by a wall, but each end of the wall in the axial direction of the screw shaft has a connecting hole through which the first chamber and the second chamber communicate. The first screw 10K mixes the developing agent by rotating the helical fighting and carries the developing agent from the distal end to the proximal end of the screw in the direction perpendicular to the drawing plane while rotating. The first screw 10K is disposed parallel to and facing the developing roller 9K. The black developing agent is delivered along the axial (shaft) direction of the developing roller 9K. The first screw 10K supplies the developing agent to the surface of the developing roller 9K along the direction of the shaft line of the developing roller 9K.

The developing agent transported near the proximal end of the first screw 10K passes through the connecting hole in the wall near the proximal side and enters the second chamber. Subsequently, the developing agent is carried by the helical fighting of the second screw 11K. As the second screw 11K rotates, the developing agent is delivered from the proximal end to the distal end in FIG. 2 while being mixed in the direction of rotation.

In the second chamber, a toner density sensor for detecting the density of the toner in the developing agent is disposed at the bottom of a casing of the chamber. As the toner density sensor, a magnetic permeability detector is employed. There is a correlation between the toner density and the magnetic permeability of the developing agent consisting of toner particles and magnetic carrier particles. Therefore, the magnetic permeability detector can detect the density of the toner.

Although not illustrated, the image forming apparatus includes toner supply devices to supply independently toners of yellow, magenta, cyan, and black to the second chamber of the respective developing devices 8Y, 8M, 8C, and 8K. The controller of the image forming apparatus includes a Random Access Memory (RAM) to store a target output voltage Vtref for output voltages provided by the toner density sensors for yellow, magenta, cyan, and black. If the difference between the output voltages provided by the toner density sensors for yellow, magenta, cyan, and black, and Vtref for each color exceeds a predetermined value, the toner supply devices are driven for a predetermined time period corresponding to the difference to supply toner. Accordingly, the respective color of toner is supplied to the second chamber of the respective developing device 8.

The developing roller 9K in the developing portion 12K faces the first screw 10K as well as the photoconductor 2K through an opening formed in the casing of the developing device 8K. The developing roller 9K includes a cylindrical developing sleeve made of a non-magnetic pipe which is rotated, and a magnetic roller disposed inside the developing sleeve. The magnetic roller is fixed so as not to rotate together with the developing sleeve. The black developing agent supplied from the first screw 10K is carried on the surface of the developing sleeve due to the magnetic force of the magnetic roller. As the developing sleeve rotates, the developing agent is transported to a developing area facing the photoconductor 2K.

The developing sleeve is supplied with a developing bias having the same polarity as the polarity of toner. An absolute value of the developing bias is greater than the potential of the electrostatic latent image on the photoconductor 2K, but less than the charge potential of the uniformly charged photoconductor 2K. With this configuration, a developing potential that causes the toner on the developing sleeve to move electrostatically to the electrostatic latent image on the photoconductor 2K acts between the developing sleeve and the electrostatic latent image on the photoconductor 2K. A non-developing potential acts between the developing sleeve and the non-image formation areas of the photoconductor 2K, causing the toner on the developing sleeve to move to the sleeve surface. Due to the developing potential and the non-developing potential, the toner on the developing sleeve moves selectively to the electrostatic latent image formed on the photoconductor 2K, thereby forming a visible image, known as a toner image.

Similar to the toner image forming unit 1K, toner images of yellow, magenta, and cyan are formed on the photoconductors 2Y, 2M, and 2C of the toner image forming units 1Y, 1M, and 1C, respectively. The optical writing unit 80 for writing a latent image on the photoconductors 2 is disposed above the toner image forming units 1Y, 1M, 1C, and 1K. Based on image information provided by an external device such as a personal computer (PC), the optical writing unit 80 illuminates the photoconductors 2Y, 2M, 2C, and 2K with the laser light projected from a laser diode of the optical writing unit 80. Accordingly, the electrostatic latent images of yellow, magenta, cyan, and black are formed on the photoconductors 2Y, 2M, 2C, and 2K, respectively.

The optical writing unit 80 includes a polygon mirror, a plurality of optical lenses, and mirrors. The light beam projected from the laser diode serving as a light source is deflected in a main scanning direction by the polygon mirror rotated by a polygon motor. The deflected light, then, strikes the optical lenses and mirrors, thereby scanning the photoconductor 2Y. Alternatively, the optical writing unit 80 may employ a light source using an LED array including a plurality of LEDs that projects light.

Referring back to FIG. 1, a description is provided of the transfer unit 30. The transfer unit 30 is disposed below the toner image forming units 1Y, 1M, 1C, and 1K. The transfer unit 30 includes the intermediate transfer belt 31 serving as an image bearing member formed into an endless loop and rotated in the counterclockwise direction. The transfer unit also includes a plurality of rollers: a drive roller 32, a secondary-transfer first roller 33, a cleaning auxiliary roller 34, and four primary transfer rollers 35Y, 35M, 35C, and 35K (which may be referred to collectively as primary transfer rollers 35). The primary transfer rollers 35Y, 35M, 35C, and 35K are disposed opposite to the photoconductors 2Y, 2M, 2C, and 2K, respectively, via the intermediate transfer belt 31.

The secondary-transfer first roller 33 is disposed inside the looped intermediate transfer belt 31 and contacts the back surface of the intermediate transfer belt 31 which is an opposite surface to the front surface. The transfer unit 30 also includes a belt cleaning device 37 and a density sensor 40.

The intermediate transfer belt 31 is entrained around and stretched taut between the plurality of rollers. i.e., the drive roller 32, the secondary-transfer first roller 33, the cleaning auxiliary roller 34, and the four primary transfer rollers 35Y, 35M, 35C, and 35K. The drive roller 32 is rotated in the counterclockwise direction by a motor or the like, and rotation of the driving roller 32 enables the intermediate transfer belt 31 to rotate in the same direction.

The intermediate transfer belt 31 is interposed between the photoconductors 2Y, 2M, 2C, and 2K, and the primary transfer rollers 35Y, 35M, 35C, and 35K. Accordingly, primary transfer nips are formed between the outer peripheral surface or the image bearing surface of the intermediate transfer belt 31 and the photoconductors 2Y, 2M, 2C, and 2K that contact the intermediate transfer belt 31. A primary transfer power source applies a primary transfer bias to the primary transfer rollers 35Y, 35M, 35C, and 35K. Accordingly, a transfer electric field is formed between the primary transfer rollers 35Y, 35M, 35C, and 35K, and the toner images of yellow, magenta, cyan, and black formed on the photoconductors 2Y, 2M, 2C, and 2K. The yellow toner image formed on the photoconductor 2Y enters the primary transfer nip for yellow as the photoconductor 2Y rotates. Subsequently, the yellow toner image is primarily transferred from the photoconductor 2Y to the intermediate transfer belt 31 by the transfer electrical field and the nip pressure. The intermediate transfer belt 31, on which the yellow toner image has been transferred, passes through the primary transfer nips of magenta, cyan, and black.

Subsequently, the toner images on the photoconductors 2M, 2C, and 2K are superimposed on the yellow toner image which has been transferred on the intermediate transfer belt 31, one atop the other, thereby forming a composite toner image on the intermediate transfer belt 31 in the primary transfer process. Accordingly, the composite toner image, in which the toner images of yellow, magenta, cyan, and black are superimposed one atop the other, is formed on the surface of the intermediate transfer belt 31. According to the illustrative embodiment described above, a roller-type transfer device (here, the primary transfer rollers 35) is used as a primary transfer device. Alternatively, a transfer charger or a brush-type transfer device may be employed as a primary transfer device.

A sheet conveyor unit 38, disposed substantially below the transfer unit 30, includes a secondary-transfer second roller 36 disposed opposite to the secondary-transfer first roller 33 via the intermediate transfer belt 31 and a sheet conveyor belt 41 (generally referred to as a secondary transfer belt or a secondary transfer member). As illustrated in FIG. 1, the sheet conveyor belt 41 is formed into an endless loop and looped around a plurality of rollers including the secondary-transfer second roller 36. As the secondary-transfer second roller 36 is driven to rotate, the sheet conveyor belt 41 is rotated in the clockwise direction in FIG. 1.

The secondary-transfer second roller 36 contacts, via the sheet conveyor belt 41, a portion of the front surface or the image bearing surface of the intermediate transfer belt 31 looped around the secondary-transfer first roller 33, thereby forming a secondary transfer nip therebetween. That is, the intermediate transfer belt 31 and the sheet conveyor belt 41 are interposed between the secondary-transfer first roller 33 of the transfer unit 30 and the secondary-transfer second roller 36 of the sheet conveyor unit 38. Accordingly, the outer peripheral surface or the image bearing surface of the intermediate transfer belt 31 contacts the outer peripheral surface of the sheet conveyor belt 41 serving as the nip forming member, thereby forming the secondary transfer nip.

The secondary-transfer second roller 36 disposed inside the loop of the sheet conveyor belt 41 is grounded; whereas, a secondary transfer bias is applied to the secondary-transfer first roller 33 disposed inside loop of the intermediate transfer belt 31 by a secondary transfer power source 39. With this configuration, a secondary transfer electrical field is formed between the secondary-transfer first roller 33 and the secondary-transfer second roller 36 so that the toner having a negative polarity is transferred electrostatically from the secondary-transfer first roller side to the secondary-transfer second roller side. Alternatively, instead of the sheet conveyor belt 41, a secondary transfer roller may be employed as the nip forming device to contact directly the intermediate transfer belt 31.

As illustrated in FIG. 1, the sheet cassette 100 storing a sheaf of recording sheets P is disposed below the transfer unit 31. The sheet cassette 100 is equipped with a feed roller

100*a* that contacts the top sheet of the sheaf of recording sheets P. As the feed roller 100*a* is rotated at a predetermined speed, the sheet feed roller 100*a* picks up and sends the top sheet of the recording sheets P to a sheet delivery path. Substantially near the end of the sheet delivery path, the pair of registration rollers 101 is disposed. The pair of registration rollers 101 stops rotating temporarily as soon as the recording sheet P fed from the sheet cassette 100 is interposed between the pair of registration rollers 101. The pair of registration rollers 101 starts to rotate again to feed the recording sheet P to the secondary transfer nip in appropriate timing such that the recording sheet P is aligned with the composite toner image formed on the intermediate transfer belt 31 at the secondary transfer nip.

In the secondary transfer nip, the recording sheet P tightly contacts the composite toner image on the intermediate transfer belt 31, and the composite toner image is secondarily transferred onto the recording sheet P by the secondary transfer electric field and the nip pressure applied thereto, thereby forming a full-color toner image on the recording sheet P. The recording sheet P, on which the full-color toner image is formed, passes through the secondary transfer nip and separates from the intermediate transfer belt 31 due to self-stripping. Furthermore, the curvature of a separation roller 42, around which the sheet conveyor belt 41 is looped, enables the recording sheet P to separate from the sheet conveyor belt 41.

According to the present illustrative embodiment, the sheet conveyor belt 41 as the nip forming device contacts the intermediate transfer belt 31 to form the secondary transfer nip. Alternatively, a nip forming roller as the nip forming device may contact the intermediate transfer belt 31 to form the secondary transfer nip.

After the intermediate transfer belt 31 passes through the secondary transfer nip N, residual toner not having been transferred onto the recording sheet P remains on the intermediate transfer belt 31. The residual toner is removed from the intermediate transfer belt 31 by the belt cleaning device 37 which contacts the surface of the intermediate transfer belt 31. The cleaning auxiliary roller 34 disposed inside the loop formed by the intermediate transfer belt 31 supports the cleaning operation performed by the belt cleaning device 37.

As illustrated in FIG. 1, the density sensor 40 is disposed outside the loop formed by the intermediate transfer belt 31. More specifically, the density sensor 40 faces a portion of the intermediate transfer belt 31 looped around the drive roller 32 with a predetermined gap between the density sensor 40 and the intermediate transfer belt 31. An amount of toner adhered to the toner image per unit area (image density) primarily transferred onto the intermediate transfer belt 31 is measured when the toner image comes to the position opposite to the density sensor 40.

The fixing device 90 is disposed downstream from the secondary transfer nip in the direction of conveyance of the recording sheet P. The fixing device 90 includes a fixing roller 91 and a pressing roller 92. The fixing roller 91 includes a heat source such as a halogen lamp inside the fixing roller 91. While rotating, the pressing roller 92 pressingly contacts the fixing roller 91, thereby forming a heated area called a fixing nip therebetween. The recording sheet P bearing an unfixed toner image on the surface thereof is delivered to the fixing device 90 and interposed between the fixing roller 91 and the pressing roller 92 in the fixing device 90. Under heat and pressure, the toner adhered to the toner image is softened and fixed to the recording sheet P in the fixing nip. Subsequently, the recording sheet P is output outside the image forming apparatus from the fixing device 90 via a post-fixing delivery path after the fixing process.

According to the illustrative embodiment, for forming a monochrome image, an orientation of a support plate supporting the primary transfer rollers 35Y, 35M, and 35C of the transfer unit 30 is changed by driving a solenoid or the like. With this configuration, the primary transfer rollers 35Y, 35M, and 35C are separated from the photoconductors 2Y, 2M, and 2C, thereby separating the outer peripheral surface or the image bearing surface of the intermediate transfer belt 31 from the photoconductors 2Y, 2M, and 2C. In a state in which the intermediate transfer belt 31 contacts only the photoconductor 2K, only the toner image forming unit 1K for black among four toner image forming units is driven to form a black toner image on the photoconductor 2K. It is to be noted that the present disclosure can be applied to both an image forming apparatus for forming a color image and a monochrome image forming apparatus for forming a single-color image.

Figure 3:
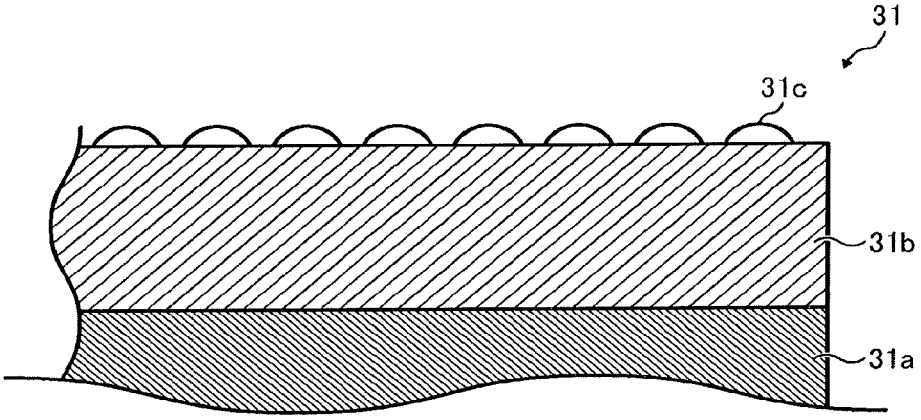
FIG. 3 is a partially enlarged cross-sectional view schematically illustrating an intermediate transfer belt employed in the image forming apparatus of FIG. 1.
Figure 4:
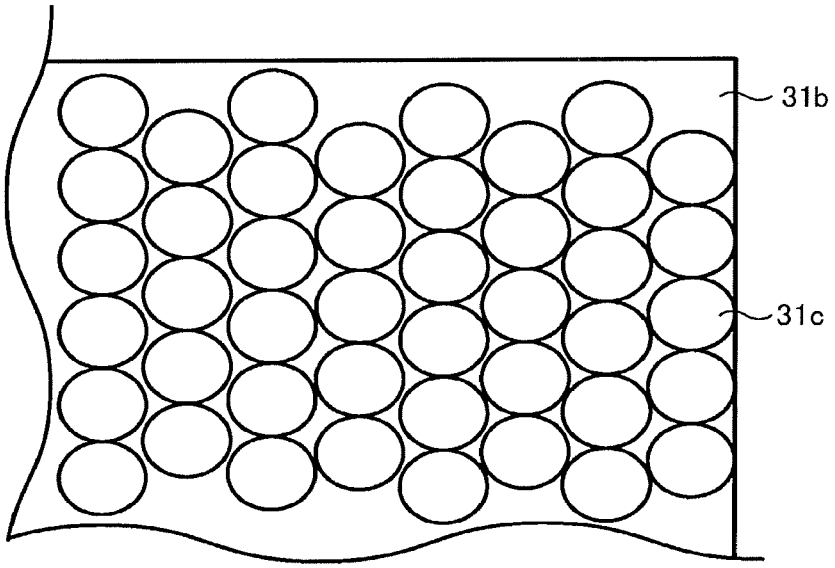
FIG. 4 is a partially enlarged plan view schematically illustrating the intermediate transfer belt.

FIG. 3 is a partially enlarged cross-sectional view schematically illustrating a transverse plane of the intermediate transfer belt 31. As illustrated in FIG. 3, the intermediate transfer belt 31 includes a base layer 31*a* and an elastic layer 31*b*. The base layer 31*a* formed into an endless looped belt is formed of a material having a high stiffness, but having some flexibility. The elastic layer 31*b* disposed on the front surface of the base layer 31*a* is formed of an elastic material with high elasticity. Particles 31*c* are dispersed in the elastic layer 31*b*. While a portion of the particles 31*c* projects from the elastic layer 31*b*, the particles 31*c* are arranged concentratedly in a belt surface direction as illustrated in FIG. 4. With these particles 31*c*, an uneven surface of the belt with multiple bumps is formed on the intermediate transfer belt 31.

Examples of materials for the base layer 31*a* include, but are not limited to, a resin in which an electrical resistance adjusting material made of a filler or an additive is dispersed to adjust electrical resistance. Examples of the resin constituting the base layer 31*a* include, but are not limited to, fluorine-based resins such as ethylene tetrafluoroethylene copolymers (ETFE) and polyvinylidene fluoride (PVDF) in terms of flame retardancy, and polyimide resins or polyamide-imide resins. In terms of mechanical strength (high elasticity) and heat resistance, specifically, polyimide resins or polyamide-imide resins are more preferable.

Examples of the electrical resistance adjusting materials dispersed in the resin include, but are not limited to, metal oxides, carbon blacks, ion conductive materials, and conductive polymers. Examples of metal oxides include, but are not limited to, zinc oxide, tin oxide, titanium oxide, zirconium oxide, aluminum oxide, and silicon oxide. In order to enhance dispersiveness, surface treatment may be applied to metal oxides in advance. Examples of carbon blacks include, but are not limited to, ketchen black, furnace black, acetylene black, thermal black, and gas black. Examples of ion conductive materials include, but are not limited to, tetraalkylammonium salt, trialkyl benzyl ammonium salt, alkylsulfonate, alkylbenzene sulfonate, alkylsulfate, glycerol esters of fatty acid, sorbitan fatty acid ester, polyoxyethylene alkylamine, polyoxyethylene aliphatic alcohol ester, alkylbetaine, and lithium perchlorate. Two or more ion conductive materials can be mixed. It is to be noted that electrical resistance adjusting materials are not limited to the above-mentioned materials.

A dispersion auxiliary agent, a reinforcing material, a lubricating material, a heat conduction material, an antioxidant, and so forth may be added to a coating liquid which is a precursor for the base layer 31*a*, as needed. The coating solution is a liquid resin before curing in which electrical resistance adjusting materials are dispersed. An amount of the electrical resistance adjusting materials to be dispersed in the base layer 31*a* of a seamless belt, i.e., the intermediate transfer belt 31 is preferably in a range from $1\times10^{8}$ to $1\times10^{13}$ Ω/sq in surface resistivity, and in a range from $1\times10^{6}$ to $10^{12}$ Ω·cm in volume resistivity.

In terms of mechanical strength, an amount of the electrical resistance adjusting material to be added is determined such that the formed film is not fragile and does not crack easily. Preferably, a coating liquid, in which a mixture of the resin component (for example, a polyimide resin precursor and a polyamide-imide resin precursor) and the electrical resistance adjusting material are adjusted properly, is used to manufacture a seamless belt (i.e., the intermediate transfer belt 31) in which the electrical characteristics (i.e., the surface resistivity and the volume resistivity) and the mechanical strength are well balanced. The content of the electrical resistance adjusting material in the coating liquid when using carbon black is in a range from 10% to 25% by weight or preferably, from 15% to 20% by weight relative to the solid content. The content of the electrical resistance adjusting material in the coating liquid when using metal oxides is approximately 150% by weight or more preferably, in a range from 10% to 30% by weight relative to the solid content.

If the content of the electrical resistance adjusting material is less than the above-described respective range, a desired effect is not achieved. If the content of the electrical resistance adjusting material is greater than the above-described respective range, the mechanical strength of the intermediate transfer belt (seamless belt) 31 drops, which is undesirable in actual use.

The thickness of the base layer 31*a* is not limited to a particular thickness and can be selected as needed. The thickness of the base layer 31*a* is preferably in a range from 30 μm to 150 μm, more preferably in a range from 40 μm to 120 μm, even more preferably, in a range from 50 μm to 80 μm. The base layer 31*a* having a thickness of less than 30 μm cracks and gets torn easily. The base layer 31*a* having a thickness of greater than 150 μm cracks when it is bent. By contrast, if the thickness of the base layer 31*a* is in the above-described respective range, the durability is enhanced.

In order to increase the stability of traveling of the intermediate transfer belt 31, preferably, the thickness of the base layer 31*a* is uniform as much as possible. An adjustment method to adjust the thickness of the base layer 31*a* is not limited to a particular method, and can be selected as needed. For example, the thickness of the base layer 31*a* can be measured using a contact-type or an eddy-current thickness meter or a scanning electron microscope (SEM) which measures a cross-section of the film.

As described above, the elastic layer 31*b* of the intermediate transfer belt 31 includes an uneven surface formed with the particles 31*c* dispersed in the elastic layer 31*b*. Examples of elastic materials for the elastic layer 31*b* include, but are not limited to, generally-used resins, elastomers, and rubbers. Preferably, elastic materials having good elasticity such as elastomer materials and rubber materials are used. Examples of the elastomer materials include, but are not limited to, polyesters, polyamides, polyethers, polyurethanes, polyolefins, polystyrenes, polyacrylics, polydiens, silicone-modified polycarbonates, and thermoplastic elastomers such as fluorine-containing copolymers. Examples of thermosetting resins include, but are not limited to, polyurethane resins, silicone-modified epoxy resins, and silicone modified acrylic resins. Examples of rubber materials include, but are not limited to isoprene rubbers, styrene rubbers, butadiene rubbers, nitrile rubbers, ethylene-propylene rubbers, butyl rubbers, silicone rubbers, chloroprene rubbers, acrylic rubbers, chlorosulfonated polyethylenes, fluorocarbon rubbers, urethane rubbers, and hydrin rubbers.

A material having desired characteristics can be selected from the above-described materials. In particular, in order to accommodate a recording sheet with an uneven surface such as Leathac (registered trademark), soft materials are preferable. Because the particles 31*c* are dispersed, thermosetting materials are more preferable than thermoplastic materials. The thermosetting materials have a good adhesion property relative to resin particles due to an effect of a functional group contributing to the curing reaction, thereby fixating reliably. For the same reason, vulcanized rubbers are also preferable.

In terms of ozone resistance, softness, adhesion properties relative to the particles, application of flame retardancy, environmental stability, and so forth, acrylic rubbers are most preferable among elastic materials for forming the elastic layer 31*b*. Acrylic rubbers are not limited to a specific product. Commercially-available acrylic rubbers can be used. An acrylic rubber of carboxyl group crosslinking type is preferable since the acrylic rubber of the carboxyl group crosslinking type among other cross linking types (e.g., an epoxy group, an active chlorine group, and a carboxyl group) provides good rubber physical properties (specifically, the compression set) and good workability. Preferably, amine compounds are used as crosslinking agents for the acrylic rubber of the carboxyl group crosslinking type. More preferably, multivalent amine compounds are used. Examples of the amine compounds include, but are not limited to, aliphatic multivalent amine crosslinking agents and aromatic multivalent amine crosslinking agents. Furthermore, examples of the aliphatic multivalent amine crosslinking agents include, but are not limited to, hexamethylenediamine, hexamethylenediamine carbamate, and N,N'-dicinnamylidene-1,6-hexanediamine. Examples of the aromatic multivalent amine crosslinking agents include, but are not limited to, 4,4'-methylenedianiline, m-phenylenediamine, 4,4'-diaminodiphenyl ether, 3,4'-diaminodiphenyl ether, 4,4'-(m-phenylenediisopropylidene) dianiline, 4,4'-(p-phenylenediisopropylidene) dianiline, 2,2'-bis [4-(4-aminophenoxy)phenyl] propane, 4,4'-diaminobenzanilide, 4,4'-bis (4-aminophenoxy)biphenyl, m-xylylenediamine, p-xylylenediamine, 1,3,5-benzenetriamine, and 1,3,5-benzenetriaminomethyl.

The amount of the crosslinking agent is, preferably, in a range from 0.05 to 20 parts by weight, more preferably, from 0.1 to 5 parts by weight, relative to 100 parts by weight of the acrylic rubber. An insufficient amount of the crosslinking agent causes failure in crosslinking, hence complicating efforts to maintain the shape of crosslinked products. By contrast, too much crosslinking agent causes crosslinked products to be too stiff, hence degrading elasticity as a crosslinking rubber.

In order to enhance a cross-linking reaction, a crosslinking promoter may be mixed in the acrylic rubber employed for the elastic layer 31*b*. The type of crosslinking promoter is not limited particularly. However, it is preferable that the crosslinking promoter can be used with the above-described multivalent amine crosslinking agents. Such crosslinking promoters include, but are not limited to, guanidino compounds, imidazole compounds, quaternary onium salts, tertiary phosphine compounds, and weak acid alkali metal salts. Examples of the guanidino compounds include, but are not limited to, 1,3,1,3-diphenylguanidine, and 1,3-di-o-tolylguanidine. Examples of the imidazole compounds include, but are not limited to, 2-methylimidazole and 2-phenylimidazole. Examples of the quaternary onium salts include, but are not limited to, tetra-n-butylammonium bromide and octadecyltri-n-butylammonium bromide. Examples of the multivalent tertiary amine compounds include, but are not limited to, triethylenediamine and 1,8-diazabicyclo[5.4.0]undec-7-ene (DBU). Examples of the tertiary phosphines include, but are not limited to, triphenylphosphine and tri(p-tolyl)phosphine. Examples of the weak acid alkali metal salts include, but are not limited to, phosphates such as sodium and potassium, inorganic weak acid salts such as carbonate or stearic acid salt, and organic weak acid salts such as lauric acid salt.

The amount of the crosslinking promoter is, preferably, in a range from 0.1 to 20 parts by weight, more preferably, from 0.3 to 10 parts by weight, relative to 100 parts by weight of the acrylic rubber. Too much crosslinking promoter causes undesirable acceleration of crosslinking during crosslinking, generation of bloom of the crosslinking promoter on the surface of crosslinked products, and hardening of the crosslinked products. By contrast, an insufficient amount of the crosslinking agent causes degradation of the tensile strength of the crosslinked products and a significant elongation change or a significant change in the tensile strength after heat load.

The acrylic rubber composition of the present disclosure can be prepared by an appropriate mixing procedure such as roll mixing, Banbury mixing, screw mixing, and solution mixing. The order in which the ingredients are mixed is not particularly limited. However, it is preferable that ingredients that are not easily reacted or decomposed when heated are first mixed thoroughly, and thereafter, ingredients that are easily reacted or decomposed when heated, such as a crosslinking agent, are mixed together in a short period of time at a temperature at which the crosslinking agent is neither reacted not decomposed.

When heated, the acrylic rubber serves as a crosslinked product. The heating temperature is preferably in a range of 130° C. to 220° C., more preferably, 140° C. to 200° C. The crosslinking time period is preferably in a range of 30 seconds to 5 hours. The heating methods can be chosen from those which are conventionally used for crosslinking rubber compositions, such as press heating, steam heating, oven heating, and hot-air heating. In order to reliably crosslink the inside of the crosslinked product, post crosslinking may be additionally carried out after crosslinking is carried out once. The post crosslinking time period varies depending on the heating method, the crosslinking temperature and the shape of crosslinked product, but is carried out preferably for 1 to 48 hours.

The heating method and the heating temperature may be appropriately chosen. Electrical resistance adjusting agents for adjustment of electrical characteristics and flame retardants to achieve flame retardancy may be added to the selected materials. Furthermore, antioxidants, reinforcing agents, fillers, and crosslinking promoters may be added as needed. The electrical resistance adjusting agents to adjust electrical resistance can be selected from the above-described materials. However, since the carbon blacks and the metal oxides impair flexibility, it is preferable to minimize the amount of use. Ion conductive materials and conductive high polymers are also effective. Alternatively, these materials can be used in combination.

Preferably, various types of perchlorates and ionic liquids in an amount from about 0.01 parts by weight to 3 parts by weight are added, based on 100 parts by weight of rubber. With the ion conductive material in an amount 0.01 parts by weight or less, the resistivity cannot be reduced effectively. However, with the ion conductive material in an amount 3 parts by weight or more, it is highly possible that the conductive material blooms or bleeds to the belt surface.

The electrical resistance adjusting material to be added is in such an amount that the surface resistivity of the elastic layer 31*b* is, preferably, in a range from $1\times10^{8}$ Ω/sq to $1\times10^{13}$ Ω/sq, and the volume resistivity of the elastic layer 31*b* is, preferably, in a range from $1\times10^{6}$ Ω·cm to $1\times10^{12}$ Ω·cm. In order to obtain high toner transferability relative to an uneven surface of a recording sheet as is desired in image forming apparatuses using electrophotography in recent years, it is preferable to adjust a micro rubber hardness of the elastic layer 31*b* to 35 or less under the condition 23° C., 50% RH.

In measurement of Martens hardness and Vickers hardness, which are a so-called micro-hardness, a shallow area of a measurement target in a bulk direction, that is, the hardness of only a limited area near the surface is measured. Thus, deformation capability of the entire belt cannot be evaluated. Consequently, for example, in a case in which a soft material is used for the uppermost layer of the intermediate transfer belt 31 with a relatively low deformation capability as a whole, the micro-hardness decreases. In such a configuration, the intermediate transfer belt 31 with a low deformation capability does not conform to the surface condition of the uneven surface of the recording sheet, thereby impairing the desired transferability relative to the uneven surface of the recording sheet.

In view of the above, preferably, the micro-rubber hardness, which allows the evaluation of the deformation capability of the entire intermediate transfer belt 31, is measured to evaluate the hardness of the intermediate transfer belt 31.

The layer thickness of the elastic layer 31*b* is, preferably, in a range from 200 μm to 2 mm, more preferably, 400 μm to 1000 μm. The layer thickness less than 200 μm hinders deformation of the belt in accordance with the roughness (surface condition) of the recording sheet and a transfer-pressure reduction effect. By contrast, the layer thickness greater than 2 mm causes the elastic layer 31*b* to sag easily due to its own weight, resulting in unstable movement of the intermediate transfer belt 31 and damage to the intermediate transfer belt 31 looped around rollers. The layer thickness can be measured by observing the cross-section of the elastic layer 31*b* using a scanning electron microscope (SEM), for example.

The particle 31*c* to be dispersed in the elastic material of the elastic layer 31*b* is a spherical resin particle having an average particle diameter of equal to or less than 100 μm and are insoluble in an organic solvent. Furthermore, the 3% thermal decomposition temperature of these resin particles is equal to or greater than 200° C. The resin material of the particle 31*c* is not particularly limited, but may include acrylic resins, melamine resins, polyamide resins, polyester resins, silicone resins, fluorocarbon resins, and rubbers. Alternatively, in some embodiments, surface processing with different material is applied to the surface of the particle made of resin materials. A surface of a spherical mother particle made of rubber may be coated with a hard resin. Furthermore, the mother particle may be hollow or porous.

Among such resins mentioned above, the silicone resin particles are most preferred because the silicone resin particles provide good slidability, separability relative to toner, and wear and abrasion resistance. Preferably, the spherical resin particles are prepared through a polymerization process. The more spherical the particle is, the more preferred. Preferably, the volume average particle diameter of the particle is in a range from 1.0 μm to 5.0 μm, and the particle dispersion is monodisperse with a sharp distribution. The monodisperse particle is not a particle with a single particle diameter. The monodisperse particle is a particle having a sharp particle size distribution.

More specifically, the distribution width of the particle is equal to or less than ±(Average particle diameter×0.5 μm). With the particle diameter of the particle 31*c* less than 1.0 μm, enhancement of transfer performance by the particle 31*c* cannot be achieved sufficiently. By contrast, with the particle diameter greater than 5.0 μm, the space between the particles increases, which results in an increase in the surface roughness of the intermediate transfer belt 31. In this configuration, toner is not transferred well, and the intermediate transfer belt 31 cannot be cleaned well. In general, the particle 31*c* made of resin material has a relatively high insulation property. Thus, if the particle diameter is too large, accumulation of electrical charges of the particle diameter 31*c* during continuous printing causes image defect easily.

Either commercially-available products or laboratory-derived products may be used as the particle 31*c*. The thus-obtained particle 31*c* is directly applied to the elastic layer 31*b* and evened out, thereby evenly distributing the particle 31*c* with ease. With this configuration, an overlap of the particles 31*c* in the belt thickness direction is reduced, if not prevented entirely.

Preferably, the cross-sectional diameter of the plurality of particles 31*c* in the surface direction of the elastic layer 31*b* is as uniform as possible. More specifically, the distribution width thereof is equal to or less than±(Average particle diameter×0.5 μm). For this reason, preferably, powder including particles with a small particle diameter distribution is used as the particles 31*c*. If the particles 31*c* having a specific particle diameter can be applied to the elastic layer 31*b* selectively, it is possible to use particles having a relatively large particle diameter distribution. It is to be noted that timing at which the particles 31*c* are applied to the surface of the elastic layer 31*b* is not particularly limited. The particles 31*c* can be applied before or after crosslinking of the elastic material of the elastic layer 31*b*.

Preferably, a projected area ratio of a portion of the elastic layer 31*b* having the particles 31*c* relative to the elastic layer 31*b* with its surface being exposed is equal to or greater than 60% in the surface direction of the elastic layer 31*b*. In a case in which the projected area ratio is less than 60%, the frequency of direct contact between toner and the pure surface of the elastic layer 31*b* increases, thereby degrading transferability of toner, cleanability of the belt surface from which toner is removed, and filming resistance. In some embodiments, a belt without the particles 31*c* dispersed in the elastic layer 31*b* can be used as the intermediate transfer belt 31.

Figure 5:
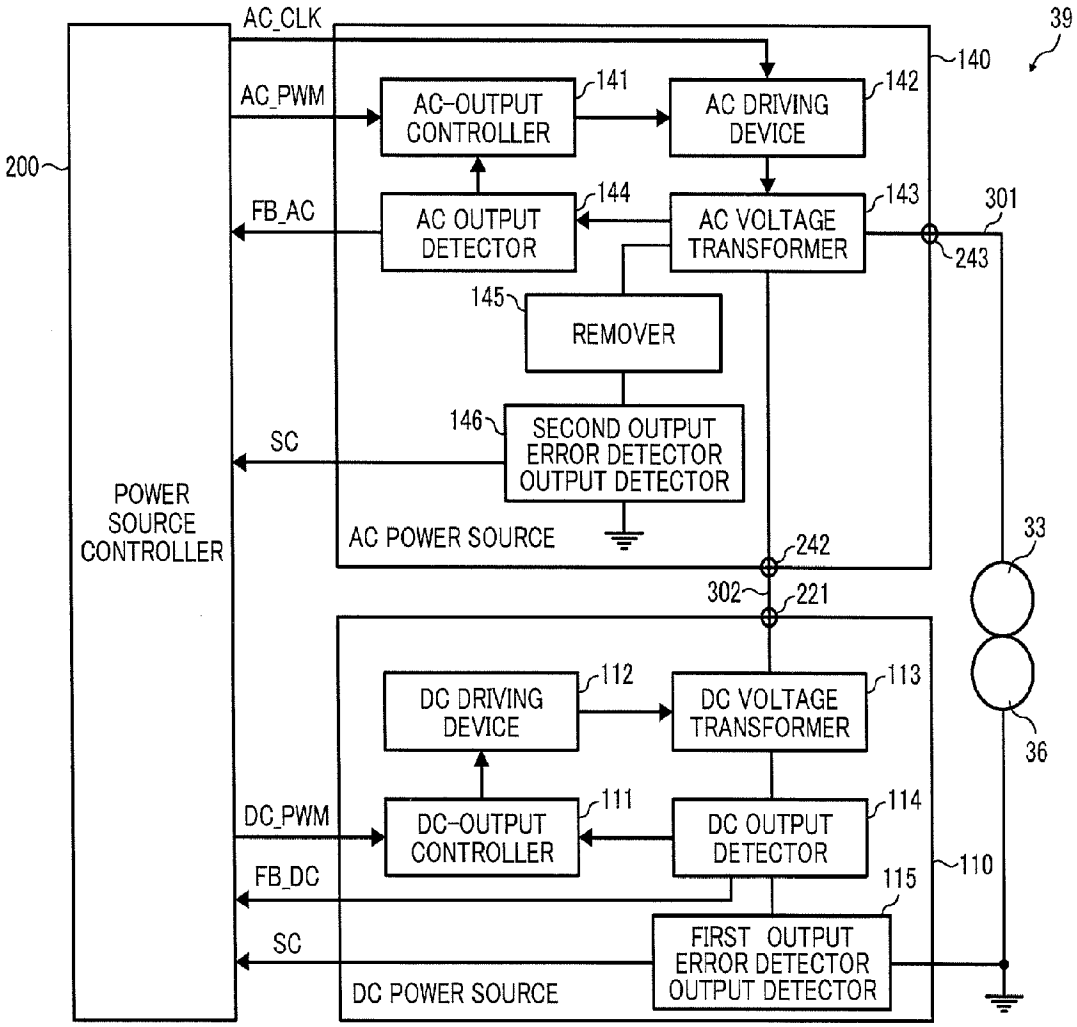
FIG. 5 is a block diagram illustrating a portion of an electrical circuit of a secondary transfer power source employed in the image forming apparatus of FIG. 1 according to an illustrative embodiment of the present disclosure.

FIG. 5 is a block diagram illustrating a portion of an electrical circuit of a secondary transfer power source employed in the image forming apparatus of FIG. 1 according to an illustrative embodiment of the present disclosure. As illustrated in FIG. 5, the secondary transfer power source 39 includes a direct-current (DC) power source 110 and an alternating current (AC) power source 140, a power source controller 200, and so forth. The AC power source 140 is detachably mountable relative to a maim body of the secondary transfer power source 39. The DC power source 110 outputs a DC voltage to apply an electrostatic force to toner on the intermediate transfer belt 31 so that the toner moves from the belt side to the recording sheet side in the secondary transfer nip. The DC power source 110 includes a DC output controller 111, a DC driving device 112, a DC voltage transformer 113, a DC output detector 114, a first output error detector 115, an electrical connector 221, and so forth.

The AC power source 140 outputs an alternating current voltage to form an alternating electric field in the secondary transfer nip N. The AC power source 140 includes an AC output controller 141, an AC driving device 142, an AC voltage transformer 143, an AC output detector 144, a remover 145, a second output error detector 146, electrical connectors 242 and 243, and so forth.

The power source controller 200 controls the DC power source 110 and the AC power source 140, and is equipped with a central processing unit (CPU), a Read Only Memory (ROM), a Random Access Memory (RAM), and so forth. The power source controller 200 inputs a DC_PWM signal to the DC output controller 111. The DC_PWM signal controls an output level of the DC voltage. Furthermore, an output value of the DC voltage transformer 113 detected by the DC output detector 114 is provided to the DC output controller 111. Based on the duty ratio of the input DC_PWM signal and the output value of the DC voltage transformer 113, the DC output controller 111 controls the DC voltage transformer 113 via the DC driving device 112 to adjust the output value of the DC voltage transformer 113 to an output value instructed by the DC_PWM signal.

The DC driving device 112 drives the DC voltage transformer 113 in accordance with the instruction from the DC output controller 111. The DC driving device 112 drives the DC voltage transformer 113 to output a DC high voltage having a negative polarity. In a case in which the AC power source 140 is not connected, the electrical connector 221 and the secondary-transfer first roller 33 are electrically connected by a harness 301 so that the DC voltage transformer 113 outputs (applies) a DC voltage to the secondary-transfer first roller 33 via the harness 301. In a case in which the AC power source 140 is connected, the electrical connector 221 and the electrical connector 242 are electrically connected by a harness 302 so that the DC voltage transformer 113 outputs a DC voltage to the AC power source 140 via the harness 302.

The DC output detector 114 detects and outputs an output value of the DC high voltage from the DC voltage transformer 113 to the DC output controller 111. The DC output detector 114 outputs the detected output value as a FB_DC signal (feedback signal) to the power source controller 200 to control the duty of the DC_PWM signal in the power source controller 200 so as not to impair transferability due to environment and load. According to the present illustrative embodiment, the AC power source 140 is detachably mountable relative to the main body of the secondary transfer power source 39. Thus, an impedance in the output path of the high voltage output is different between when the AC power source 140 is connected and when the AC power source 140 is not connected. Consequently, when the DC power source 110 outputs the DC voltage under constant voltage control, the impedance in the output path changes depending on the presence of the AC power source 140, thereby changing a division ratio. Furthermore, the high voltage to be applied to the secondary-transfer first roller 33 varies, causing the transferability to vary depending on the presence of the AC power source 140.

In view of the above, according to the present illustrative embodiment, the DC power source 110 outputs the DC voltage under constant current control, and the output voltage is changed depending on the presence of the AC power source 140. With this configuration, even when the impedance in the output path changes, the high voltage to be applied to the secondary-transfer first roller 33 is kept constant, thereby maintaining reliably the transferability irrespective of the presence of the AC power source 140. Furthermore, the AC power source 140 can be detached and attached without changing the DC_PWM signal value. According to the present illustrative embodiment, the DC power source 110 is under constant-current control. Alternatively, in some embodiments, the DC power source 110 can be under constant voltage control as long as the high voltage to be applied to the secondary-transfer first roller 33 is kept constant by changing the DC_PWM signal value upon detachment and attachment of the AC power source 140 or the like.

The first output error detector 115 is disposed on an output line of the DC power source 110. When an output error occurs due to a ground fault or other problems in an electrical system, the first output error detector 115 outputs an SC signal indicating the output error such as leakage. With this configuration, the power source controller 200 can stop the DC power source 110 to output the high voltage.

The power source controller 200 inputs an AC_PWM signal and an output value of the AC voltage transformer 143 detected by the AC output detector 144. The AC_PWM signal controls an output level of the AC voltage. Based on the duty ratio of the input AC_PWM signal and the output value of the AC voltage transformer 143, the AC output controller 141 controls the AC voltage transformer 143 via the AC driving device 142 to adjust the output value of the AC voltage transformer 143 to an output value instructed by the AC_PWM signal.

An AC_CLK signal to control the output frequency of the AC voltage is input to the AC driving device 142. The AC driving device 142 drives the AC voltage transformer 143 in accordance with the instruction from the AC output controller 141 and the AC_CLK signal. As the AC driving device 142 drives the AC voltage transformer 143 in accordance with the AC_CLK signal, the output waveform generated by the AC voltage transformer 143 is adjusted to a desired frequency instructed by the AC_CLK signal.

The AC driving device 142 drives the AC voltage transformer 143 to generate an AC voltage, and the AC voltage transformer 143 then generates a superimposed voltage in which the generated AC voltage and the DC high voltage output from the DC voltage transformer 113 are superimposed. In a case in which the AC power source 140 is connected, that is, the electrical connector 243 and the secondary-transfer first roller 33 are electrically connected by the harness 301, the AC voltage transformer 143 outputs (applies) the thus-obtained superimposed voltage to the secondary-transfer first roller 33 via the harness 301. In a case in which the AC voltage transformer 143 does not generate the AC voltage, the AC voltage transformer 143 outputs (applies) the DC high voltage output from the DC voltage transformer 113 to the secondary-transfer first roller 33 via the harness 301. Subsequently, the voltage (the superimposed voltage or the DC voltage) provided to the secondary-transfer first roller 33 returns to the DC power source 110 via the secondary-transfer second roller 36. The AC output detector 144 detects and outputs an output value of the AC voltage from the AC voltage transformer 143 to the AC output controller 141. The AC output detector 144 outputs the detected output value as a FB_AC signal (feedback signal) to the power source controller 200 to control the duty of the AC_PWM signal in the power source controller 200 to prevent the transferability from dropping due to environment and load. The AC power source 140 carries out constant voltage control. Alternatively, in some embodiments, the AC power source 140 may carry out constant current control. The waveform of the AC voltage generated by the AC voltage transformer 143 (the AC power source 140) is either a sine wave or a square wave. According to the present illustrative embodiment, the waveform of the AC voltage is a short-pulse square wave. The AC voltage having a short-pulse square wave can enhance image quality.

Figure 6:
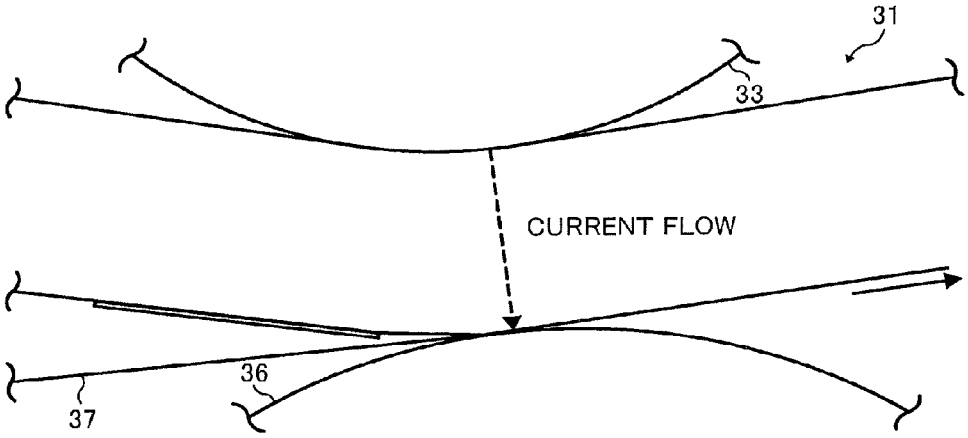
FIG. 6 is a partially enlarged cross-sectional view schematically illustrating a structure around a secondary transfer nip using a single-layer intermediate transfer belt which is different from the image forming apparatus of the present disclosure.

FIG. 6 is an enlarged diagram schematically illustrating a structure around the secondary transfer nip using a single-layer intermediate transfer belt as the intermediate transfer belt 31. In a case in which the single-layer intermediate transfer belt is used as the intermediate transfer belt 31, a secondary transfer current flows between the secondary-transfer first roller 33 and the secondary-transfer second roller 36 in a manner described below. That is, the secondary transfer current is concentrated at the nip center (the center in the traveling direction of the belt) and flows linearly as indicated by an arrow in FIG. 6. In other words, the secondary transfer current does not flow much near the nip start portion of the secondary transfer nip and near the nip end portion of the secondary transfer nip. When the secondary transfer current flows in such a manner described above, the time period during which the secondary transfer current acts on the toner is relatively short at the secondary transfer nip. Accordingly, excessive injection of electrical charges having a polarity opposite that of the normal polarity due to the secondary transfer current is suppressed, if not prevented entirely.

Figure 7:
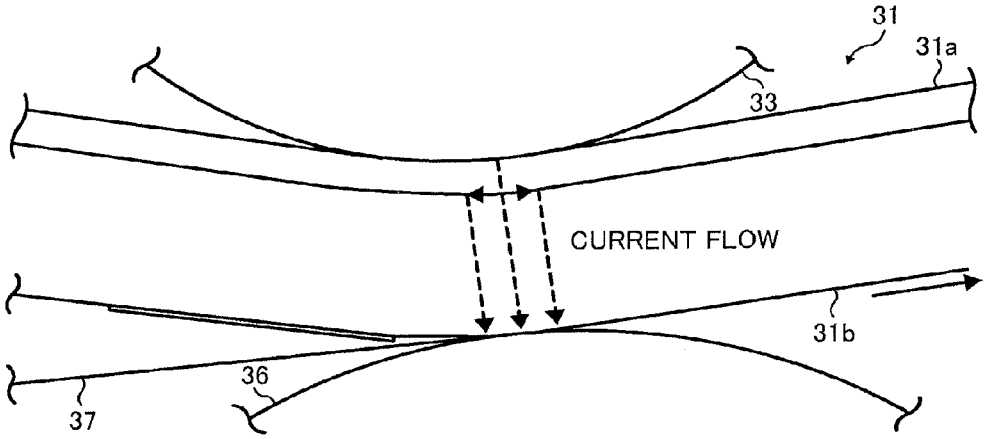
FIG. 7 is a partially enlarged cross-sectional view schematically illustrating a secondary transfer nip and a surrounding structure according to an illustrative embodiment of the present disclosure.

FIG. 7 is a partially enlarged cross-sectional view schematically illustrating the secondary transfer nip and a surrounding structure according to an illustrative embodiment of the present disclosure.

According to the present illustrative embodiment, as described above, a multi-layer intermediate transfer belt is used as the intermediate transfer belt 31. In a case in which the multi-layer intermediate transfer belt is used as the intermediate transfer belt 31, a secondary transfer current flows between the secondary-transfer first roller 33 and the secondary-transfer second roller 36 in a manner described below. When using the multilayer intermediate transfer belt as the intermediate transfer belt 31, the secondary transfer current flows through an interface between the base layer 31*a* and the elastic layer 31*b* in the belt thickness direction while the secondary transfer current spreads in the circumferential direction of the intermediate transfer belt 31. As a result, the secondary transfer current flows not only in the center of the secondary transfer nip, but also at the nip start portion and at the nip end portion. This means that the secondary transfer current acts on the toner in the secondary transfer nip for an extended period of time. Thus, electrical charges having a polarity opposite to the normal polarity are easily and excessively injected to the toner due to the secondary transfer current, which results in a significant decrease in the amount of charge of the toner having the normal polarity and also results in a reverse charging of the toner.

In both cases, the secondary transfer ability is impaired. As a result, the image density becomes inadequate easily. Not only the two-layer belt such as in the present illustrative embodiment, but also the belt having multiple layers including three more layers causes the similar spread of the secondary transfer current, which also impairs the secondary transfer ability.

Figure 8:
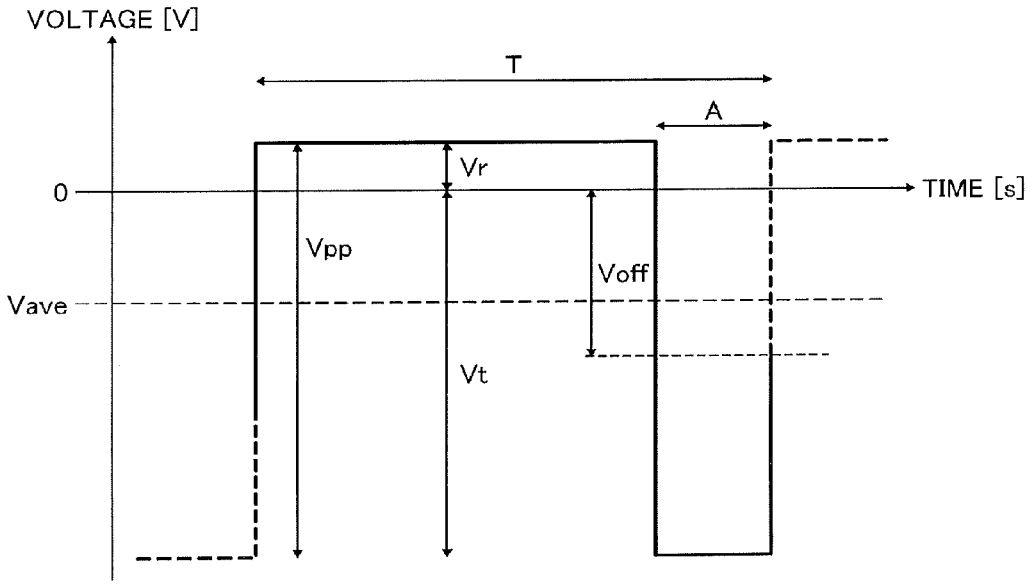
FIG. 8 is a waveform chart showing a waveform of a secondary bias output from a secondary transfer power source according to an illustrative embodiment of the present disclosure.

With reference to FIG. 8, a description is provided of a characteristic configuration of the image forming apparatus according to the present illustrative embodiment of the present disclosure. FIG. 8 is a waveform chart showing a waveform of a secondary bias output from the secondary transfer power source 39 according to an illustrative embodiment of the present disclosure.

According to the present illustrative embodiment, the secondary transfer bias is applied to the secondary-transfer first roller 33. In this configuration, in order to secondarily transfer a toner image from the intermediate transfer belt 31 onto a recording sheet P, it is necessary to employ the secondary transfer bias having the characteristics described below. That is, a time-averaged polarity of the secondary transfer bias is similar to or the same polarity as the charge polarity of toner. More specifically, as illustrated in FIG. 8, the secondary transfer bias includes an alternating voltage, the polarity of which is inverted cyclically due to superimposed DC and AC voltages.

On time average, the polarity of the secondary transfer bias is negative which is the same as the polarity of the toner. Using the secondary transfer bias having the negative time-averaged polarity, the toner is repelled relatively by the secondary-transfer first roller 33, thereby enabling the toner to electrostatically move from the belt side toward the recording sheet side. In a case in which the secondary transfer bias is applied to the secondary-transfer second roller 36, the secondary transfer bias having the time-averaged polarity opposite to the polarity of the toner is used. With such a secondary transfer bias, the toner is electrostatically attracted relatively to the secondary-transfer second roller 36, thereby enabling the toner to electrostatically move from the belt side toward the recording sheet side.

In FIG. 8, T represents one cycle of the secondary transfer bias with the polarity that alternates cyclically. In FIG. 8, Vr represents a reverse-polarity peak value which is a peak value of a positive polarity, that is, the polarity opposite to the charge polarity of the toner. When the secondary transfer bias has the reverse-polarity peak value Vr, electrostatic migration of the toner from the belt side to the recording sheet side is inhibited. In FIG. 8, Vt represents a same-polarity peak value which is a peak value of the same negative polarity as the charge polarity of the toner. When the secondary transfer bias has the same-polarity peak value Vt, electrostatic migration of the toner from the belt side to the recording sheet side is accelerated.

In FIG. 8, Voff represents an offset voltage as a DC component value of the secondary transfer bias and coincides with a solution to an equation (Vr+Vt)/2. Vpp represents a peak-to-peak value.

The secondary transfer bias has a waveform with a duty (i.e. duty ratio) greater than 50% in the cycle T. The duty (duty ratio) is a time ratio based on an inhibition time period during which the electrostatic migration of the toner from the intermediate transfer belt side to the recording sheet side in the secondary transfer nip is inhibited in a first time period and a second time period of the waveform.

According to the present illustrative embodiment, the first time period is a time period in the cycle T of the waveform from when the secondary transfer bias starts rising beyond the zero line as the baseline towards the positive polarity side to a time after the secondary transfer bias falls to the zero line, but immediately before the secondary transfer bias starts falling from the zero line towards the negative polarity side. The second time period is a time period in the cycle T of the waveform from when the secondary transfer bias starts falling towards the negative polarity side from the zero line to a time after the secondary transfer bias rises to the zero line, but immediately before the secondary transfer bias starts further rising beyond the zero line towards the positive polarity side. In the first time period, the toner is prevented from electrostatically moving from the belt side to the recording sheet P side. In other words, the first time period corresponds to the inhibition time period. Therefore, the duty is the time ratio based on the first time period (during which the polarity is positive) in the cycle T. The duty of the secondary transfer bias of the image forming apparatus is obtained by the following equation: (T−A)/T×100(%), where A is the second time period.

In FIG. 8, Vave represents an average potential of the secondary transfer bias and coincides with a solution to an equation "Vr×Duty/100+Vt×(1−Duty)/100". Furthermore, A represents the second time period (i.e., a time period obtained by subtracting the inhibition time period from the cycle T in the present illustrative embodiment.) T indicates a cycle of an alternating current component of the secondary transfer bias.

As illustrated in FIG. 8, in the secondary transfer bias, the time period during which the secondary transfer bias has a positive polarity is greater than half the cycle T. That is, the duty is greater than 50%. With such a secondary transfer bias, the time period, during which electrical charges having the positive polarity opposite to the charge polarity of the toner may possibly be injected to the toner in the cycle T, is shortened. Accordingly, a decrease in the charge amount of toner Q/M caused by the injection of the electrical charges in the secondary transfer nip can be suppressed, if not prevented entirely. With this configuration, degradation of the secondary transfer ability caused by a decrease in the charge amount of toner is prevented, hence obtaining adequate image density.

Even when the duty is greater than 50%, the toner image can be secondarily transferred in a manner described below. That is, an area of the positive side of the graph with 0V as a reference is smaller than that of the negative side of the graph so that the average potential has a negative polarity, thereby enabling the toner to electrostatically move relatively from the belt side to the recording sheet side.

Figure 9:
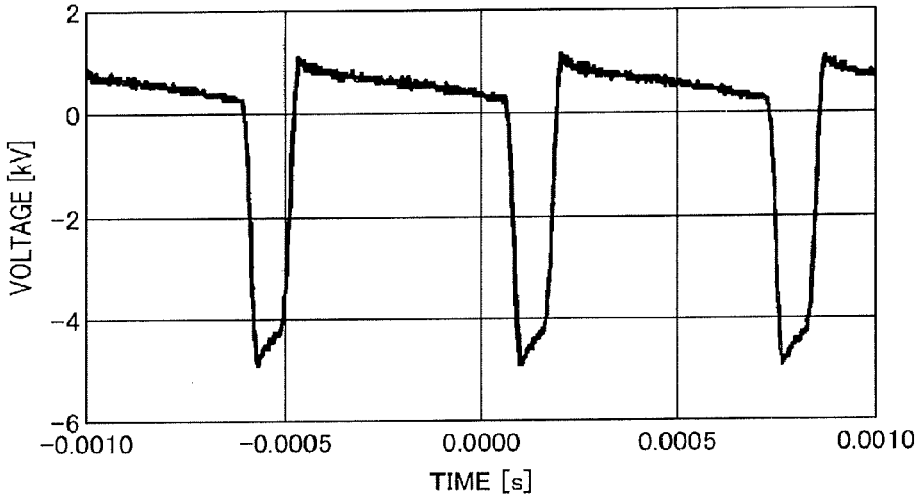
FIG. 9 is a waveform chart showing a waveform of a secondary bias with a duty of 85% output from a secondary transfer power source of a prototype image forming apparatus.

FIG. 9 is a waveform chart showing a waveform of the secondary transfer bias output from the secondary transfer power source 39 of a prototype image forming apparatus. In FIG. 9, the same-polarity peak value Vt is −4.8 kV. The reverse-polarity peak value Vr is 1.2 kV. The offset voltage Voff is −1.8 kV. The average potential Vave is 0.08 kV. The peak-to-peak value Vpp is 6.0 kV. The second time period A is 0.10 ms. The cycle T is 0.66 ms. The duty is 85%.

The present inventors have performed printing tests with different duties of the secondary transfer bias under the following conditions:

Environment condition (temperature/humidity): 27° C./80%

Type of recording sheet P: Coated sheet, i.e., Mohawk Color Copy Gloss 270 gsm (457 mm×305 mm)

Process linear velocity: 630 mm/s

Test image: Black halftone image

Width of the secondary transfer nip (the length in the traveling direction of the belt): 4 mm Same-polarity peak value Vt: −4.8 kV Reverse-polarity peak value Vr: 1.2 kV Offset voltage Voff: −1.8 kV Average potential Vave: 0.08 kV Peak-to-peak value Vpp: 6.0 kV Second time period A: 0.10 ms Cycle T: 0.66 ms Duty: 90%, 70%, 50%, 30%, 10%

Figure 10:
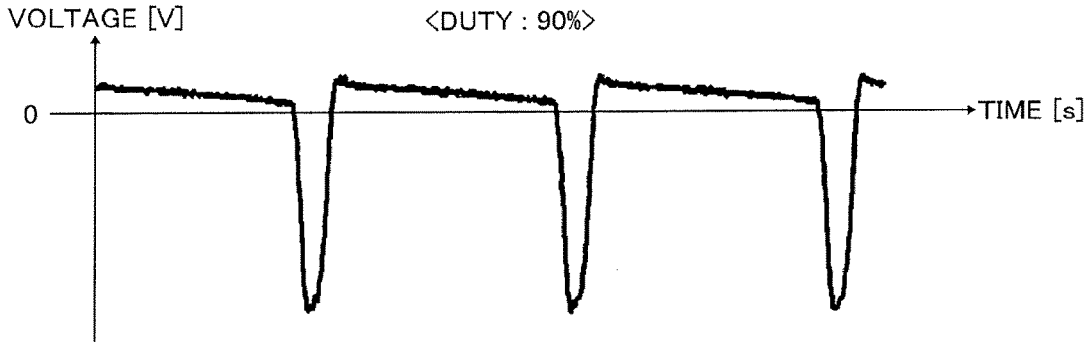
FIG. 10 is a waveform chart showing a waveform of a secondary bias with a duty of 90% output from the secondary transfer power source of the prototype image forming apparatus.
Figure 11:
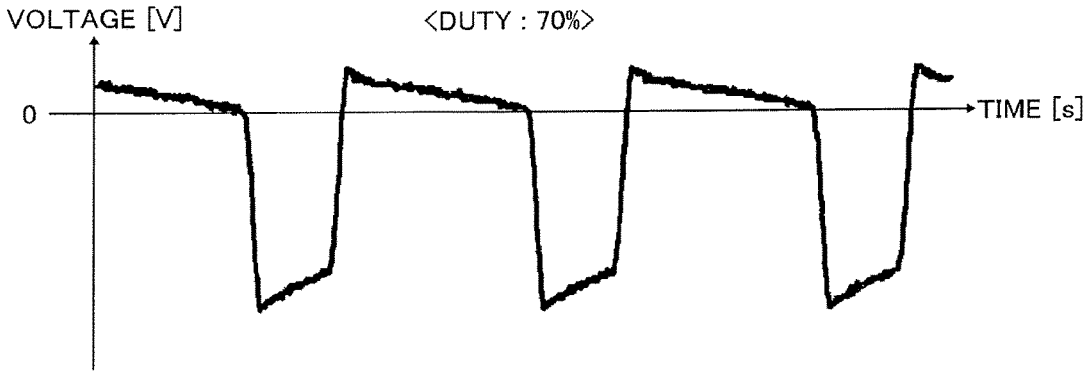
FIG. 11 is a waveform chart showing a waveform of a secondary bias with a duty of 70% output from the secondary transfer power source of the prototype image forming apparatus.
Figure 12:
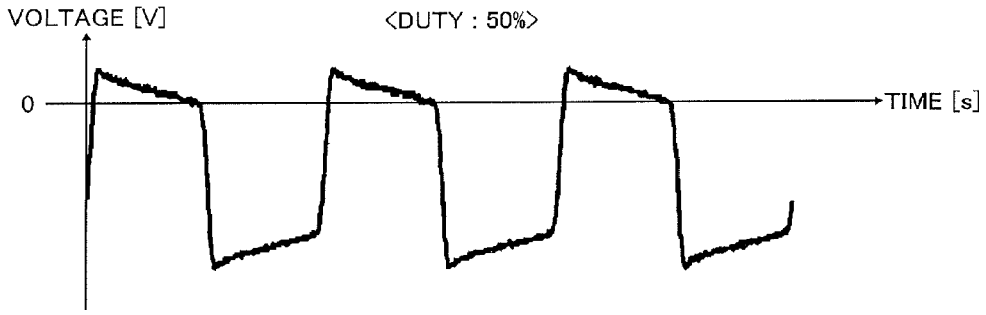
FIG. 12 is a waveform chart showing a waveform of a secondary bias with a duty of 50% output from the secondary transfer power source of the prototype image forming apparatus.
Figure 13:
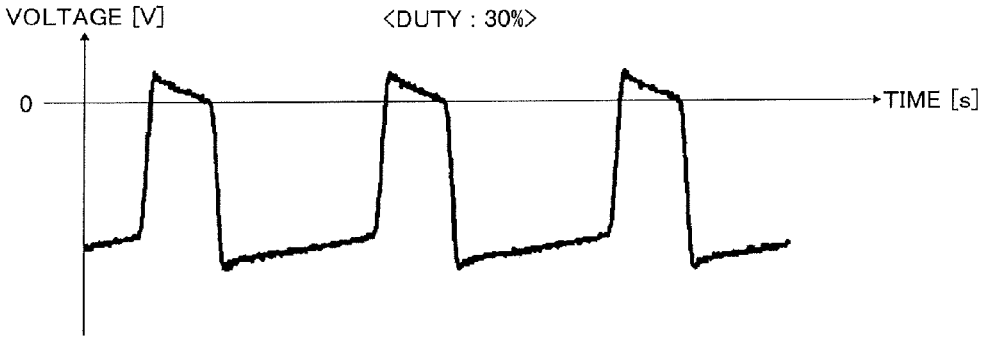
FIG. 13 is a waveform chart showing a waveform of a secondary bias with a duty of 30% output from the secondary transfer power source of the prototype image forming apparatus.
Figure 14:
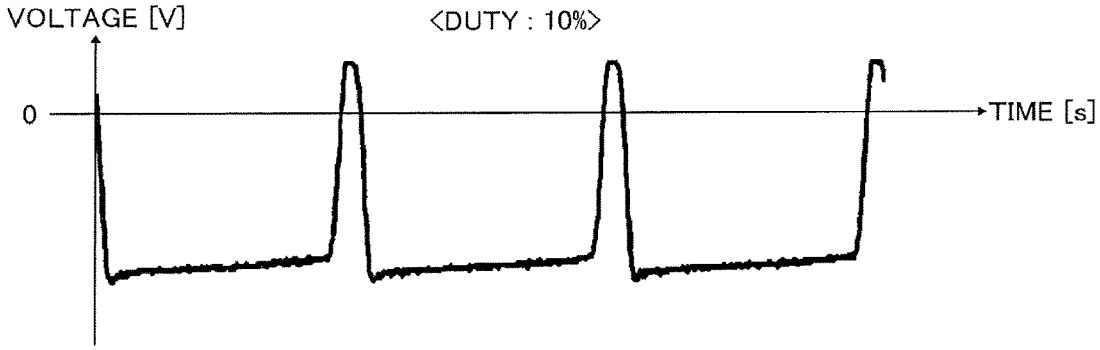
FIG. 14 is a waveform chart showing a waveform of a secondary bias with a duty of 10% output from the secondary transfer power source of the prototype image forming apparatus.

FIG. 10 is a waveform chart showing an actual output waveform of the secondary transfer bias with the duty of 90%. FIG. 11 is a waveform chart showing an actual output waveform of the secondary transfer bias with the duty of 70%. FIG. 12 is a waveform chart showing an actual output waveform of the secondary transfer bias with the duty of 50%. FIG. 13 is a waveform chart showing an actual output waveform of the secondary transfer bias with the duty of 30%. FIG. 14 is a waveform chart showing an actual output waveform of the secondary transfer bias with the duty of 10%.

The results are shown in Table 1.

TABLE 1

| DUTY (%) | 90 | 70 | 50 | 30 | 10 |
|---|---|---|---|---|---|
| EVALUATION ON TRANSFERABILITY | 5 | 5 | 3 | 1 | 1 |

In Table 1, reproducibility of image density of test images were graded on a five point scale of 1 to 5, with 5 indicating that the density of a halftone test image was adequate. 4 indicates that the density was slightly lower than that of Grade 5, but the density was good enough so as not to cause a problem. 3 indicates that the density was lower than that of Grade 4, and desired image quality to satisfy users was not obtained. 2 indicates that the density was lower than that of Grade 3. 1 indicates that the test image looked generally white or even whiter (less density). The acceptable image quality to satisfy users was 4 or above.

With the duty of 10% and 30%, the time period, during which electrical charges having the opposite polarity may possibly be injected to the toner in the cycle T, was relatively long. Therefore, a decrease in the charge amount of toner Q/M due to the injection of reverse electrical charges was significant. As a result, as shown in Table 1, the image density was graded as 1 which indicates that the image density was inadequate significantly.

By contrast, with the duty of 70% and 90%, the time period, during which electrical charges having the opposite polarity may possibly be injected to the toner in the cycle T, was relatively short. Therefore, a decrease in the charge amount of toner Q/M due to the injection of reverse electrical charges was suppressed effectively. As a result, as shown in Table 1, the image density was graded as 5 which indicates that the desired image density was obtained.

As shown in the drawings, with the secondary transfer bias, the polarity of which alternately changes in the cycle T, the injection of reverse electrical charges to the toner can be prevented more reliably. In this configuration, even when the recording sheet P is charged the electric field having the polarity that prevents the injection of the reverse charges acts relatively in the secondary transfer nip.

The same experiments were performed using regular paper, instead of the above-described coated sheets. The experiment conditions are described below.

Environment condition (temperature/humidity): 27° C./80%

Type of recording sheet: Normal (regular paper)

Process linear velocity: 630 mm/s

Test image: Black halftone image

Width of the secondary transfer nip (the length in the traveling direction of the belt): 4 mm Same-polarity peak value Vt: −4.8 kV Reverse-polarity peak value Vr: 1.2 kV Offset voltage Voff: −1.8 kV Average potential Vave: 0.08 kV Peak-to-peak value Vpp: 6.0 kV Second time period A: 0.10 ms Cycle T: 0.66 ms Duty: 90%, 70%, 50%, 30%, 10%

The relations between the duty and the evaluation of the transferability were similar to the coated sheet shown in Table 1.

Generally, as illustrated in FIGS. 9 through 14, the waveform of the secondary transfer bias consisting of a superimposed bias is not a clean square wave. If the waveform is a clean square wave, a time period from the rise of waveform to the fall of the waveform can be easily specified as the toner-transfer inhibition time period in one cycle. If the waveform is not such a clean square wave, the inhibition time period cannot be specified. That is, in a case in which a certain amount of time period is required (i.e., when the required time period is not zero) for the wave to rise from a first peak value (for example, the same-polarity peak value Vt) to a second peak value (for example, the reverse-polarity peak), or to fall from the second peak value to the first peak value, the above-described specifying process cannot be performed.

In view of the above, if the waveform is not a clean square wave, the duty is defined as follows. That is, among one peak value (e.g., the first peak value) of the peak-to-peak value and another peak value (e.g., the second peak value) in the cyclical movement of the waveform of the secondary transfer bias, whichever inhibits more the electrostatic migration of toner from the belt side to the recording sheet side in the secondary transfer nip, is defined as an inhibition peak value.

Figure 17:
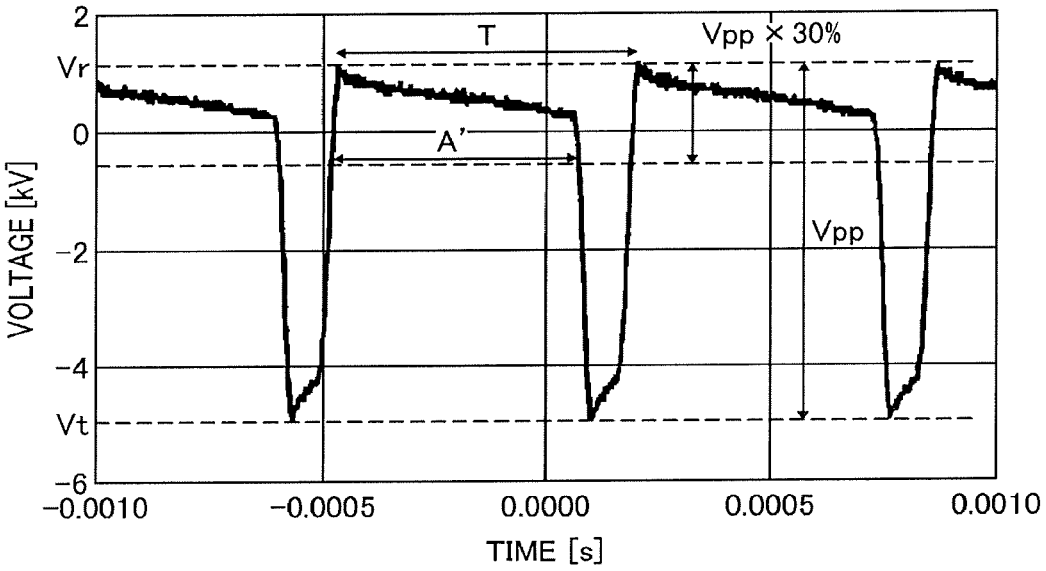
FIG. 17 is a graph for explaining a definition of the duty.

According to the present illustrative embodiment, the peak value at the positive side is defined as the inhibition peak value. The position, at which the inhibition peak value is shifted towards the another peak value by an amount equal to 30% of the peak-to-peak value, is defined as the baseline of the waveform. A time period, during which the waveform is on the inhibition peak side relative to the baseline, is defined as an inhibition time period A'. More specifically, the inhibition time period A' is a time period from when the waveform starts rising or falling from the baseline towards the inhibition peak value to immediately before the waveform falls or rises to the baseline. The duty is defined as a ratio of the inhibition time period A' to the cycle T. More specifically, a solution of an equation "(Inhibition time period A'/Cycle T)×100%" in FIG. 17 is obtained as the duty.

According to the present illustrative embodiment, the toner having a negative polarity is used, and the secondary transfer bias is applied to the secondary-transfer first roller 33. Thus, the reverse-polarity peak value Vr is the inhibition peak value. The inhibition time period A' is a time period from when the waveform starts rising from the baseline towards the reverse-polarity peak value Vr to a time after the waveform falls to the baseline, but immediately before the waveform starts falling further towards the same-polarity peak value Vt. By contrast, in a configuration in which the toner having a negative polarity is used and the secondary transfer bias is applied to the secondary-transfer second roller 36, the secondary transfer bias having a reversed waveform which is a waveform shown in FIG. 17 reversed at 0 V as a reference is used. In this case, the same-polarity peak value Vt is the inhibition peak value. More specifically, the inhibition time period A' is a time period when the waveform starts falling from the baseline towards the same-polarity peak value Vt to a time after the waveform rises to the baseline, but immediately before the waveform further rises towards the reverse-polarity peak value Vr.

Figure 15:
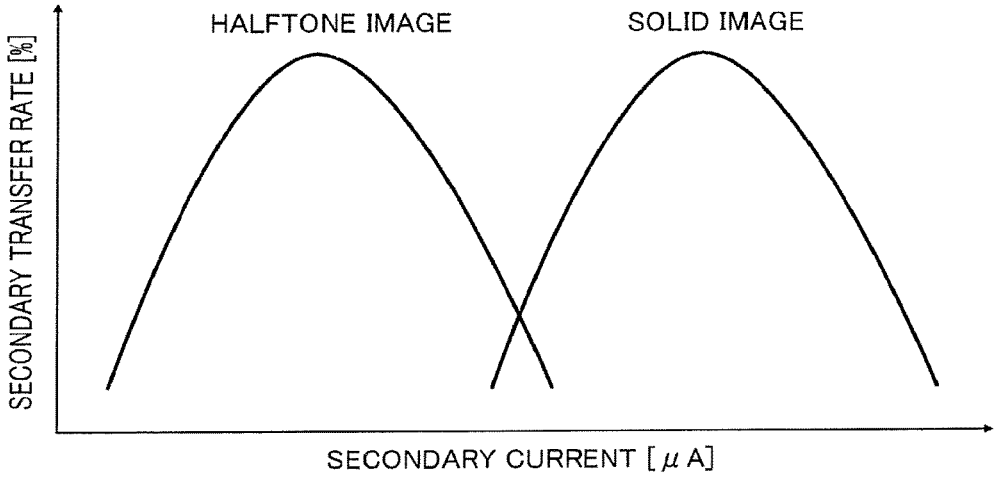
FIG. 15 is a graph showing relations between a secondary transfer rate and a secondary transfer current.

FIG. 15 is a graph showing relations between a secondary transfer rate and a secondary transfer current. The secondary transfer rate is a ratio of the toner adhesion amount (per unit area) of the toner image on the intermediate transfer belt 31 before entering the secondary transfer nip relative to an amount of transferred toner. More specifically, the amount of transferred toner refers to a toner adhesion amount (per unit area) of the toner image that is secondarily transferred onto a recording sheet P after passing through the secondary transfer nip. As illustrated in FIG. 15, the graph showing relations between the secondary transfer rate and the secondary transfer current has a parabolic curve such as in a normal distribution. This indicates that when the secondary transfer current is too much or too little, good secondary transfer ability is not achieved, and in order to maximize the secondary transfer ability there is an optimum secondary transfer current suitable for the maximum secondary transfer ability.

As illustrated in FIG. 15, the proper secondary transfer current is lower for the halftone image which generally has a relatively small toner adhesion amount per unit area than for the solid image which generally has a relatively large toner adhesion amount. Among general users, the solid image is output more frequently than the halftone image. If the secondary transfer current is set in accordance with the solid image, upon output of the halftone image the secondary transfer ability cannot be maximized. Because the secondary transfer current flows excessively in the halftone image having generally less toner adhesion amount, the electrical charges having a polarity opposite to the polarity of the toner are injected to the toner. As a result, an inadequate toner adhesion amount Q/M and the reversely charged toner cause the secondary transfer failure. Therefore, especially in the halftone image, the image density becomes inadequate more easily.

Figure 16:
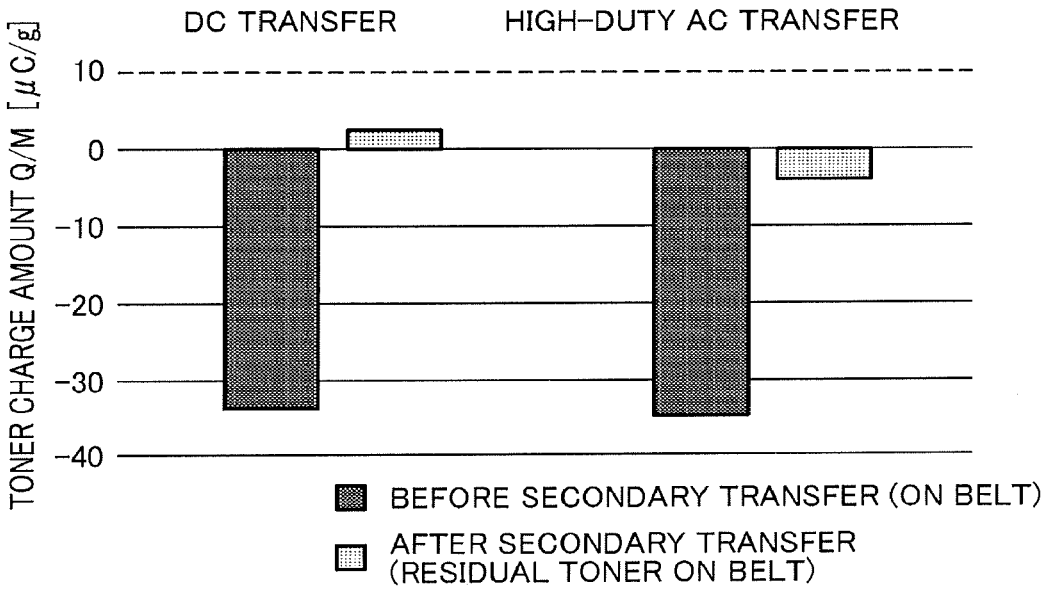
FIG. 16 is a graph showing relations between a charge amount of toner Q/M [μC/g] and a transfer method.

FIG. 16 is a graph showing relations between a charge amount of toner Q/M [μC/g] and a transfer method. In direct current (DC) transfer shown in FIG. 16, only a direct current (DC) voltage having a negative polarity is used as the secondary transfer bias. The duty in this case is 0%. In high-duty alternating current (AC) transfer, a superimposed bias with a duty greater than 50% is used as the secondary transfer bias, similar to the illustrative embodiment of the present disclosure. The duty in this case is 85%.

As illustrated in FIG. 16, in the DC transfer using the secondary transfer bias with the duty of 0%, the toner after the secondary transfer is reversely charged, that is, the toner has a positive polarity after the secondary transfer. The electric current having a polarity that enhances electrostatic migration of the toner from the belt side to the sheet side acts on the toner for a relatively long period of time in the secondary transfer nip. As a result, a significant amount of electrical charges having a polarity opposite to the polarity of the toner is injected to the toner. By contrast, in the high-duty AC transfer, the polarity of the toner after the secondary transfer remains negative, which is a normal charge of the toner. When the above-described time period is shortened even more by setting the duty to 85%, the amount of injection of electrical charges to the toner is reduced. More specifically, the amount of injection of electrical charges having the opposite polarity is reduced. With this configuration, using the secondary transfer bias with a high duty, the injection of the reverse electrical charges to the toner is reduced, hence suppressing or preventing secondary transfer failure.

According to the present illustrative embodiment, as the intermediate transfer belt 31, a belt with an upper most layer (i.e., the elastic layer 31*b*) in which particles (the particles 31*c*) are dispersed is used. With this configuration, a contact area of the belt surface with the toner in the secondary transfer nip can be reduced, and hence the ability of separation of the toner from the belt surface can be enhanced. The transfer rate can be enhanced. However, when the secondary transfer current flows concentrically between the insulating particles 31*c* which are arranged regularly, the electrical charges having an opposite polarity get injected easily to the toner. As a result, even when the particles 31*c* are dispersed to enhance the transfer rate, the secondary transfer rate may decrease. In view of this, the secondary transfer bias with a high duty is employed to reliably enhance the secondary transfer rate by the particles 31*c*.

As the particles 31*c*, particles capable of getting oppositely charged to the normal charging polarity of the toner having an opposite charging property According to the present illustrative embodiment, the particles 31*c* are constituted of melamine resin particles having a positive charging property. With this configuration, electrical charges of the particles 31*c* suppress concentration of the secondary transfer current between the particles, hence further reducing the injection of opposite electrical charges to the toner.

Alternatively, in some embodiments, particles having charge property of the same charge polarity as the normal charge polarity of the toner are used as the particles 31*c*. For example, silicone resin particles having a negative charge property (i.e., Tospearl (trade name)) can be used.

In some embodiments, the intermediate transfer belt 31 may include an uppermost layer made of urethane or Teflon (registered trademark). Alternatively, the intermediate transfer belt 31 may include multiple layers made of resins such as polyimide and polyamide-imide. With either belts, using the secondary transfer bias with a high duty can prevent inadequate image density.

Although the embodiment of the present disclosure has been described above, the present disclosure is not limited to the foregoing embodiments, but a variety of modifications can naturally be made within the scope of the present disclosure.

[Aspect A]

An image forming apparatus includes an image bearer (e.g., the intermediate transfer belt 31) including a plurality of layers, a toner image forming device (e.g., the toner image forming unit 1Y, 1M, 1C, 1K) to form a toner image on the image bearer, a nip forming device (e.g., the sheet conveyor belt 41) to contact a surface of the image bearer to form a transfer nip in which a recording sheet (e.g., the recording sheet P) is interposed and the toner image is transferred from the image bearer onto the recording sheet, and a transfer power source (e.g., the secondary transfer power source 39) to output a superimposed bias (e.g., the secondary transfer bias) in which a direct current (DC) voltage is superimposed on an alternating current (AC) voltage to cause a transfer current to flow in the transfer nip. The superimposed bias has a duty greater than 50% which is a ratio of a first time period or a second time period, whichever inhibits an electrostatic migration of toner from the image bearer to the recording sheet in the secondary transfer nip, to one cycle of a waveform of the superimposed bias. The first time period is a time period from a time at which a periodic fluctuation of the waveform starts rising from a predetermined baseline towards a first peak to a time after the waveform falls to the baseline, but immediately before the waveform starts falling towards a second peak. The second time period is a time period from a time at which the waveform starts falling from the predetermined baseline towards the second peak to a time after the waveform rises to the predetermined baseline, but immediately before the waveform starts further rising from the predetermined baseline towards the first peak.

Using the image bearer having multiple layers can enhance transferability of the toner image to the recording sheet having an uneven surface.

Furthermore, using the transfer bias having the duty greater than 50% can reduce the time period during which the electrical charges having the opposite polarity are injected to the toner in the transfer nip in one cycle of the transfer bias with the potential that alternates cyclically due to the superimposed alternating current voltage. That is, the time period during which the electrical charges having the opposite polarity are injected to the toner is shorter than the time period during which the injection will not occur.

With this configuration, the charge amount of toner Q/M caused by the injection of opposite charges to the toner in the secondary transfer nip is prevented from decreasing, and hence the toner image can be transferred well to the recording sheet with a relatively smooth surface such as a coated sheet. Accordingly, inadequate image density is prevented.

[Aspect B]

An image forming apparatus includes an image bearer including a plurality of layers, a toner image forming device to form a toner image on the image bearer, a nip forming device to contact a surface of the image bearer to form a transfer nip in which a recording sheet is interposed and the toner image is transferred from the image bearer onto the recording sheet, and a transfer power source to output a transfer bias that periodically changes to cause a transfer current to flow in the transfer nip. A peak-to-peak value of the transfer bias includes a first peak and a second peak in a waveform of a periodic change of the transfer bias, and one of the first peak and the second peak, whichever inhibits more an electrostatic migration of toner from the image bearer to the recording sheet in the transfer nip, is an inhibition peak. A ratio of an inhibition time period relative to one cycle of the waveform is greater than 50%, where the inhibition time period is a time period in which the waveform is at an inhibition peak side relative to a baseline of the waveform. The baseline is at a position shifted by 30% of the inhibition peak towards the other peak.

With this configuration, similar to Aspect A, while enhancing the transferability of the toner image relative to the recording sheet having an uneven surface by using the image bearer having multiple layers, the toner image can be transferred well to the recording sheet with a relatively smooth surface such as a coated sheet. Accordingly, inadequate image density is prevented.

[Aspect C]

According to Aspect A or Aspect B, the plurality of layers includes an elastic layer formed of an elastic material. With this configuration, elasticity of the elastic layer allows the elastic layer to flexibly deform in the transfer nip, thereby enhancing contact of the recording sheet having an uneven surface and the image bearer.

[Aspect D]

According to Aspect C, the elastic material of the elastic layer includes multiple fine particles dispersed in the elastic material. With this configuration, the fine particles in the surface of the elastic layer can reduce the contact area of the elastic layer with the toner in the transfer nip, hence enhancing the ability of separation of the toner separating from the image bearer surface and thus enhancing the transfer rate.

[Aspect E]

According to Aspect D, as the fine particles, particles having the charging characteristics of a polarity opposite to a normal charging polarity of the toner are used. With this configuration, electrical charges of the particles suppress concentration of the transfer current between the particles, hence further reducing the injection of opposite electrical charges to the toner.

[Aspect F]

According to Aspect C, the elastic layer of the image bearer is covered with a surface layer. In this configuration, the surface layer is made of material having a good toner separation ability. Accordingly, the secondary transfer rate is enhanced.

[Aspect G]

According to Aspect A, a surface of the base of the image bearer is covered with a plurality of resin layers.

[Aspect H]

According to Aspects A through G, the transfer power source outputs the superimposed bias with the polarity that alternates in a predetermined cycle. With this configuration, even when the recording sheet P is charged the injection of opposite charges to the toner in the transfer nip is prevented reliably.

[Aspect I]

An image forming apparatus includes an image bearer including a plurality of layers, a toner image forming device to form a toner image on the image bearer, a nip forming device to contact a surface of the image bearer to form a transfer nip in which a recording sheet is interposed and the toner image is transferred from the image bearer onto the recording sheet, and a transfer power source to output a transfer bias having a polarity that alternates at a predetermined cycle to cause a transfer current to flow in the transfer nip. The transfer bias has a duty greater than 50% which is a ratio of a time period during which the polarity of the transfer bias is a first polarity opposite to a second polarity that causes toner to electrostatically move from the image bearer to the recording sheet in the transfer nip, relative to one cycle of a waveform of the transfer bias.

With this configuration, the transfer power source outputs the transfer bias having a clean square wave. Accordingly, the same effect as that of Aspect A can be achieved.

With this configuration, while enhancing the transferability of the toner image relative to the recording sheet having an uneven surface by using the image bearer having multiple layers, the toner image can be transferred well to the recording sheet with a relatively smooth surface such as a coated sheet. Inadequate image density is prevented.

[Aspect J]

An image forming apparatus includes an image bearer including a plurality of layers, a toner image forming device to form a toner image on the image bearer, a nip forming device to contact a surface of the image bearer to form a transfer nip in which a recording sheet is interposed and the toner image is transferred from the image bearer onto the recording sheet, and a transfer power source to output a transfer bias having a polarity that alternates at a predetermined cycle to cause a transfer current to flow in the transfer nip. A waveform of the transfer bias includes a first peak at a first polarity side and a second peak at a second polarity side that causes toner to electrostatically move from the image bearer to the recording sheet in the transfer nip. The first polarity side is opposite to the second polarity side. A ratio of a time period, during which the waveform is at a first peak side relative to a baseline in one cycle of the waveform, is greater than 50%, and the baseline is at a position shifted from the first peak by an amount equal to 30% of a peak-to-peak value towards the second peak. With this configuration, the transfer power source outputs the transfer bias having a clean square wave. Accordingly, the same effect as that of Aspect A can be achieved.

With this configuration, while enhancing the transferability of the toner image relative to the recording sheet having an uneven surface by using the image bearer having multiple layers, the toner image can be transferred well to the recording sheet with a relatively smooth surface such as a coated sheet. Inadequate image density is prevented.

[Aspect K]

An image forming apparatus includes an image bearer including a plurality of layers, a transfer member to form a transfer nip between the image bearer and the transfer member, and a power source to output a transfer bias to transfer a toner image from the image bearer onto a recording sheet in the transfer nip. The transfer bias alternates between a transfer-side bias that causes the toner image to move from the image bearer to the recording sheet, and an opposite-side bias different from the transfer-side bias. A duty ratio of a time period, during which the opposite-side bias is output, relative to one cycle of a waveform, is greater than 50%.

[Aspect L]

According to Aspect K, the transfer bias includes a first peak value (Vr) at a transfer-side bias side and a second peak value (Vt) at an opposite-side bias side. The duty ratio is a ratio of a time (A') relative to one cycle (T) of a waveform of the transfer bias, where the time A' is a time period during which the transfer bias is at the first peak value (Vr) side relative to a baseline of the waveform. The baseline is at a position shifted from the first peak (Vr) towards the second peak (Vt) by an amount equal to 30% of a peak-to-peak value (Vpp) towards the second peak.

[Aspect M]

According to Aspect K, a polarity of the transfer-side bias is opposite to a polarity of the opposite-side bias, and the duty ratio is a ratio of a time period during which the polarity of the transfer bias coincides with the polarity of the opposite-side bias in one cycle of the waveform. According to Aspects K and M, when transferring the toner image from the image bearer having the plurality of layers onto a recording sheet, adequate image density can be obtained.

[Aspect N]

According to Aspect K, the duty ratio is equal to or greater than 70%.

[Aspect O]

According to Aspect L, the duty ratio is equal to or greater than 70%.

[Aspect P]

According to Aspect M, the duty ratio is equal to or greater than 70%. According to Aspects N, O, and P, when transferring a toner image from the image bearer having a plurality of layers onto a recording sheet, adequate image density can be obtained more reliably.

[Aspect Q]

According to Aspect K, the plurality of layers includes an elastic layer. With this configuration, the transferability of a toner image relative to a recording sheet with an uneven surface can be enhanced.

[Aspect R]

According to Aspect K, the plurality of layers includes an elastic layer formed of an elastic material.

[Aspect S]

According to Aspect R, the elastic layer includes multiple fine particles dispersed in the elastic material.

[Aspect T]

According to Aspect S, the multiple fine particles have charging characteristics of a polarity opposite to a normal charging polarity of toner.

[Aspect U]

According to Aspect R, the elastic layer is covered with a surface layer.

[Aspect V]

According to Aspect K, the image bearer includes a base, and a surface of the base is covered with a plurality of resin layers.

[Aspect W]

According to Aspect K, the transfer bias is a superimposed bias in which a direct current (DC) voltage is superimposed on an alternating current (AC) voltage to cause a transfer current to flow in the transfer nip. The superimposed bias has a duty ratio greater than 50% that is a ratio of one of a first time period and a second time period in which an electrostatic migration of toner from the image bearer to the recording sheet is inhibited in the transfer nip, relative to one cycle of a waveform of the superimposed bias. The first time period is a time period from a time at which a cyclical fluctuation of the waveform starts rising from a predetermined baseline towards a first peak to a time after the waveform falls to the predetermined baseline and immediately before the waveform starts falling towards a second peak. The second time period is a time period from a time at which the waveform starts falling from the predetermined baseline towards the second peak to a time after the waveform rises to the predetermined baseline and immediately before the waveform starts further rising from the predetermined baseline towards the first peak.

[Aspect X]

According to Aspect W, the power source outputs the superimposed bias while alternating a polarity of the superimposed bias at a predetermined cycle.

[Aspect Y]

According to Aspect K, the transfer bias periodically changes to cause a transfer current to flow in the transfer nip. A peak-to-peak of the transfer bias includes a first peak and a second peak in a waveform of a periodic change of the transfer bias, and one of the first peak and the second peak is an inhibition peak at which an electrostatic migration of toner from the image bearer to the recording sheet is more inhibited in the transfer nip. A duty ratio of an inhibition time period relative to one cycle of the waveform is greater than 50%, where the inhibition time period is a time period in which the waveform is at an inhibition peak side with respect to a baseline of the waveform, the baseline being at a position shifted by an amount equal to 30% of the inhibition peak towards the other peak.

[Aspect Z]

According to Aspect K, a polarity of the transfer bias alternates at a predetermined cycle to cause a transfer current to flow in the transfer nip. The transfer bias has a duty ratio greater than 50% that is a ratio of a time period, during which the polarity of the transfer bias is a first polarity opposite to a second polarity that causes toner to electrostatically move from the image bearer to the recording sheet in the transfer nip, relative to one cycle of a waveform of the transfer bias.

[Aspect AA]

According to Aspect K, a polarity of the transfer bias alternates at a predetermined cycle to cause a transfer current to flow in the transfer nip. A waveform of the transfer bias includes a first peak at a first polarity side and a second peak at a second polarity side that causes toner to electrostatically move from the image bearer to the recording sheet in the transfer nip, the first polarity side being opposite to the second polarity side. A duty ratio of a time period, during which the waveform is at a first peak side with respect to a baseline, relative to one cycle of the waveform, is greater than 50%, and the baseline is at a position shifted from the first peak by an amount equal to 30% of a peak-to-peak value towards the second peak.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearer including a plurality of layers;

a transfer member to form a transfer nip between the image bearer and the transfer member; and a power source to output a transfer bias to transfer a toner image from the image bearer onto a recording sheet in the transfer nip, the transfer bias being generated by an AC voltage and a DC voltage that are superimposed, wherein a polarity of the transfer bias alternates between negative and positive, wherein the transfer bias alternates between a transfer-side bias that causes the toner image to electrostatically move from the image bearer to the recording sheet, and an opposite-side bias different from the transfer-side bias, and a duty ratio of a time period, during which the opposite-side bias is output, relative to one cycle of a waveform, is greater than 70%.

2. The image forming apparatus according to claim 1, wherein the duty ratio is equal to or greater than 85%.

3. The image forming apparatus according to claim 1, wherein the plurality of layers includes an elastic layer formed of an elastic material.

4. The image forming apparatus according to claim 1, wherein the polarity of the transfer bias alternates between a first polarity that causes toner to electrostatically move from the recording sheet to the image bearer and a second polarity that causes toner to electrostatically move from the image bearer to the recording sheet, and the duty ratio is a ratio of the time period, during which the polarity of the transfer bias is the first polarity, relative to one cycle of the waveform.

5. The image forming apparatus according to claim 1, wherein the transfer bias includes a transfer-side peak and an another peak, and the duty ratio is a ratio of the time period, during which the waveform is at the another peak side with respect to an average potential of the transfer bias, relative to one cycle of the waveform.

6. The image forming apparatus according to claim 1, wherein the transfer bias includes a transfer-side peak and an another peak, and the duty ratio is a ratio of the time period, during which the waveform is at the another peak side with respect to a baseline, relative to one cycle of the waveform, and the baseline is at a position shifted from the another peak by an amount equal to 30% of a peak-to-peak value towards the transfer-side peak.

7. An image forming apparatus, comprising:

an image bearer;

a sheet conveyor belt to form a transfer nip between the image bearer and the sheet conveyor belt; and a power source to output a transfer bias to transfer a toner image from the image bearer onto a recording sheet in the transfer nip, the transfer bias being an AC voltage and a DC voltage that are superimposed, wherein a polarity of the transfer bias alternates between negative and positive, wherein the transfer bias alternates between a transfer-side bias that causes the toner image to electrostatically move from the image bearer to the recording sheet, and an opposite-side bias different from the transfer-side bias, and wherein a duty ratio of a time period, during which the opposite-side bias is output, relative to one cycle of a waveform, is equal to or greater than 70%.

8. The image forming apparatus according to claim 7, wherein the duty ratio is equal to or greater than 85%.

9. The image forming apparatus according to claim 7, wherein the image bearer includes a plurality of layers.

10. The image forming apparatus according to claim 9, wherein the plurality of layers includes an elastic layer formed of an elastic material.

11. The image forming apparatus according to claim 7, wherein the polarity of the transfer bias alternates between a first polarity that causes toner to electrostatically move from the recording sheet to the image bearer and a second polarity that causes toner to electrostatically move from the image bearer to the recording sheet, and the duty ratio is a ratio of the time period, during which the polarity of the transfer bias is the first polarity, relative to one cycle of the waveform.

12. The image forming apparatus according to claim 7, wherein the transfer bias includes a transfer-side peak and an another peak, and the duty ratio is a ratio of the time period, during which the waveform is at the another peak side with respect to an average potential of the transfer bias, relative to one cycle of the waveform.

13. The image forming apparatus according to claim 7, wherein the transfer bias includes a transfer-side peak and an another peak, and the duty ratio is a ratio of the time period, during which the waveform is at the another peak (Vr) side with respect to a baseline, relative to one cycle of the waveform, and the baseline is at a position shifted from the another peak by an amount equal to 30% of a peak-to-peak value towards the transfer-side peak.

14. An image transfer method, comprising steps of:

forming a toner image on an image bearer; and applying a transfer bias to a transfer nip formed between the image bearer and a transfer member to transfer the toner image from the image bearer onto a coated sheet, wherein the transfer bias alternates between a transfer-side bias that causes the toner image to electrostatically move from the image bearer to the coated sheet, and an opposite-side bias different from the transfer-side bias, and wherein a duty ratio of a time period, during which the opposite-side bias is output, relative to one cycle of a waveform, is equal to or greater than 70%.

15. The image transfer method according to claim 14, wherein the duty ratio is equal to or greater than 85%.

16. The image transfer method according to claim 14, wherein the image bearer includes a plurality of layers.

17. The image transfer method according to claim 16, wherein the plurality of layers includes an elastic layer formed of an elastic material.

18. The image transfer method according to claim 14, wherein a polarity of the transfer bias alternates between a first polarity that causes toner to electrostatically move from the coated sheet to the image bearer and a second polarity that causes toner to electrostatically move from the image bearer to the coated sheet, and the duty ratio is a ratio of the time period, during which the polarity of the transfer bias is the first polarity, relative to one cycle of the waveform.

19. The image transfer method according to claim 14, wherein the transfer bias includes a transfer-side peak and an another peak, and the duty ratio is a ratio of the time period, during which the waveform is at the another peak side with respect to an average potential of the transfer bias, relative to one cycle of the waveform.

20. The image transfer method according to claim 14, wherein the transfer bias includes a transfer-side peak and an another peak, and the duty ratio is a ratio of the time period, during which the waveform is at the another peak side with respect to a baseline, relative to one cycle of the waveform, and the baseline is at a position shifted from the another peak by an amount equal to 30% of a peak-to-peak value towards the transfer-side peak.

* * * * *